US011177086B2

(12) United States Patent
Stocker et al.

(10) Patent No.: US 11,177,086 B2
(45) Date of Patent: Nov. 16, 2021

(54) ON-LOAD TAP CHANGER, REGULATING TRANSFORMER WITH ON-LOAD TAP CHANGER, AND METHOD FOR CONNECTING AN ON-LOAD TAP CHANGER

(71) Applicant: Maschinenfabrik Reinhausen GmbH, Regensburg (DE)

(72) Inventors: Andreas Stocker, Neutraubling (DE); Marco Hoerl, Regensburg (DE); Christian Hammer, Regensburg (DE)

(73) Assignee: MASCHINENFABRIK REINHAUSEN GMBH, Regensburg (DE)

( * ) Notice: Subject to any disclaimer, the term of this patent is extended or adjusted under 35 U.S.C. 154(b) by 232 days.

(21) Appl. No.: 16/333,598

(22) PCT Filed: Sep. 7, 2017

(86) PCT No.: PCT/EP2017/072402
§ 371 (c)(1),
(2) Date: Mar. 15, 2019

(87) PCT Pub. No.: WO2018/050522
PCT Pub. Date: Mar. 22, 2018

(65) Prior Publication Data

US 2019/0228922 A1 Jul. 25, 2019

(30) Foreign Application Priority Data

Sep. 16, 2016 (DE) ..... 10 2016 117 526.9

(51) Int. Cl.
*H01F 29/04* (2006.01)
*H01H 9/00* (2006.01)

(52) U.S. Cl.
CPC ..... *H01H 9/0016* (2013.01); *H01F 29/04* (2013.01); *H01H 9/0027* (2013.01); *H01H 9/0033* (2013.01)

(58) Field of Classification Search
USPC ..... 336/150
See application file for complete search history.

(56) References Cited

U.S. PATENT DOCUMENTS 6,060,669 A 5/2000 Dohnal et al.
2019/0066940 A1 2/2019 Meyer et al.

FOREIGN PATENT DOCUMENTS

DE 960303 C 3/1957
DE 1178511 A 9/1964
(Continued)

*Primary Examiner* — Toan T Vu
*Assistant Examiner* — Xuan Ly
(74) *Attorney, Agent, or Firm* — Leydig, Voit & Mayer, Ltd.

(57) ABSTRACT

An on-load tap changer includes: a fine selector, including: fixed contacts having a commutation contact, connectable with a main winding, and tap contacts, connectable with an associated tap of regulating windings; first and second arms that selectably contact the fixed contacts; a preselector, switchable between first and second settings, connectable with the regulating and main windings, and having: first, second, and third preselector fixed contacts, connectable in the first setting with the first preselector fixed contact and in the second setting with the second preselector fixed contact; and a load changeover switch, switchable between first and second changeover settings, and including: a first terminal connected with the first arm, a second terminal connected with the second arm, and a diverter line connected in the first changeover setting with the first terminal and in the second changeover setting with the second terminal.

13 Claims, 14 Drawing Sheets

(56) References Cited

FOREIGN PATENT DOCUMENTS

| | | | | |
|---|---|---|---|---|
| DE | 2936534 | | * | 3/1981 |
| DE | 2936534 | A1 | | 3/1981 |
| DE | 19743864 | C1 | | 4/1999 |
| DE | 102013110653 | | * | 3/2015 |
| DE | 102013110653 | A1 | | 3/2015 |
| DE | 102016104500 | B3 | | 5/2017 |
| JP | S35000723 | Y | | 1/1960 |
| JP | S4219134 | Y | | 11/1967 |

* cited by examiner

ON-LOAD TAP CHANGER, REGULATING TRANSFORMER WITH ON-LOAD TAP CHANGER, AND METHOD FOR CONNECTING AN ON-LOAD TAP CHANGER

CROSS-REFERENCE TO PRIOR APPLICATIONS

This application is a U.S. National Stage Application under 35 U.S.C. § 371 of International Application No. PCT/EP2017/072402 filed on Sep. 7, 2017, and claims benefit to German Patent Application No. DE 10 2016 117 526.9 filed on Sep. 16, 2016. The International Application was published in German on Mar. 22, 2018 as WO 2018/050522 A1 under PCT Article 21(2).

FIELD

The invention relates to an on-load tap changer for a regulating transformer, to a regulating transformer with such an on-load tap changer, and to a method for switching such an on-load tap changer.

BACKGROUND

In the simplest case, an on-load tap changer includes a fine selector with N tap contacts, which are each to be connected with an associated tap of a regulating winding of a regulating transformer, and no preselector. Thus, this on-load tap changer, which is also termed linear on-load tap changer, has a setting regulation range of N settings, and a regulating transformer with this on-load tap changer has a voltage regulating range of N voltages. In order to extend the voltage regulating range of the regulating transformer, the on-load tap changer may be equipped with a preselector in addition to its fine selector, which is also termed tap selector. This preselector can be constructed as a reversing switch, coarse selector or multiple coarse selector. A reversing switch makes it possible to connect the regulating winding of the regulating transformer selectably in the same sense or opposite sense with the unregulated winding of the regulating transformer, which is also termed main winding. With the help of a coarse selector or multiple coarse selector there is the possibility of selectably switching off or switching on a part of the main winding, which is also termed coarse tap, or several coarse taps, i.e. selectably connecting or not connecting at least one coarse tap with the regulating winding.

If, for example, the linear on-load tap changer includes a reversing switch in addition to its fine selector with N tap contacts, then the fine selector typically includes, in addition to its tap contacts, a commutation contact, which is to be connected with the main winding. This on-load tap changer, thus, typically has a setting regulation range of 2×N+1 settings, namely a lower setting regulation range of N settings, in which the reversing switch is set in such a way that it connects the regulating winding in opposite sense with the main winding, an upper setting regulating range of N settings in which the reversing switch is set in such a way that it connects the regulating winding in the same sense with the main winding, and a middle setting which corresponds with the commutation contact and in which the fine selector bridges over the regulating winding. A regulating transformer with this on-load tap changer then typically has a voltage regulating range of 2×N+1 voltages.

If, for example, the linear on-load tap changer includes a coarse selector additionally to its fine selector with N tap contacts then the fine selector typically includes, in addition to its tap contacts, a commutation contact, which is to be connected with the main winding. This on-load tap changer thus typically has a setting regulation range of 2×N+1 settings, namely a lower setting regulation range of N settings in which the coarse selector is set in such a way that it does not connect the coarse tap with the regulating winding, an upper setting regulation range with N settings in which the coarse selector is set in such a way that it connects the coarse tap with the regulating winding and a middle setting which corresponds with the commutation contact and in which the fine selector bridges over the regulating winding. A regulating transformer with this on-load tap changer then typically has a voltage regulation range of 2×N+1 voltages.

DE 1 178 511 A describes a tap changer for regulating transformers with load changeover switch, reversing switch and two tap selectors switching in alternation free of current. Each tap selector includes a plurality of fixed contacts connected with the regulating winding. The lefthand tap selector additionally includes a fixed contact, which is connected with no winding—in particular neither with the regulated winding nor with the unregulated winding—and is termed idle tap. This tap changer additionally includes a changeover switch, which produces a temporary connection between the unregulated winding and the output of the load changeover switch. The tap selectors are coupled with the reversing switch and the changeover switch in such a way by way of intermittent transmissions that the connection is produced within the time interval in which the tap selector runs on the idle tap and in that case switches over the reversing switch from one end position to the other and conversely.

In addition, DE 1 178 511 A describes in FIGS. 2 to 6 thereof the course of a switching-over process of this tap changer in time sequence. In the case of switching-down of the voltage, the following process takes place: The reversing switch includes a reversing switch arm which is connected with a contact 9 at the unregulated winding. The changeover switch includes a changeover switch arm, which is connected with the contact 9. FIG. 2 shows the initial setting of the contacts. In this setting, the reversing switch arm connects the fixed contact 7 at the lower end of the regulated winding with the contact 9 at the unregulated winding. As switching down progresses, the tap selector arms run from the fixed contact 1 to the fixed contact 7 or from the fixed contact 2 to the fixed contact 6, in which case the load changeovers take place by way of the load changeover switch. The setting of FIG. 3 is then reached. In this setting, the lefthand tap selector arm contacts the contact 6 and the righthand tap selector arm contacts the contact 7, the reversing switch arm contacts the contact 7 and the changeover switch arm contacts a lefthand idle contact 0. The load changeover switch produces the connection with the righthand tap selector arm and contact 7. In the case of further switching, the changeover switch arm passes from the lefthand idle contact 0 to a middle contact A connected with the output of the load changeover switch. The reversing switch arm thereupon travels from the contact 7 to an idle contact 0. During these switching-over processes, the lefthand tap selector arm runs from the contact 6 to an idle tap 8 of the tap selector. In that case the setting of FIG. 4 is reached. The righthand tap selector arm thereupon runs from the contact 7 to the contact 1 after the load changeover switch has previously switched over to the lefthand tap selector arm and the idle tap 8. The setting of FIG. 5 is reached. On further switching, the reversing switch arm goes from the idle contact 0 to the contact 1 and the changeover switch arm from the middle contact A to a righthand idle contact 0. During these switching-over processes the lefthand tap selector arm runs from the contact 8 to the contact 2 after the load changeover switch has previously switched back to the righthand selector arm and contact 1. In that case the setting of FIG. 6 is reached. In this setting the reversing switch arm connects the contact 1 at the upper end of the regulated winding with the contact 9 at the unregulated winding. The tap selector in the case of continued switching thereupon runs from the contact 1 to the contact 7 or from the contact 2 to the contact 6. In this setting the lowermost setting of the regulated winding connected in opposition is reached, where the smallest voltage is taken off. Switching up of the voltage takes place in reverse sequence.

DE 197 43 864 C1 describes a tap changer according to the reactor switching principle for uninterrupted load switching over by means of vacuum interrupters. Fixed selector contacts with which connection can be made by respective movable selector contacts are provided, in a housing, for each phase. Fixed preselector contacts with which respective connection can be made by a movable preselector contact are provided in this housing for each phase. Fixed bypass contacts with which connection can be made by respective movable bypass contacts are provided in this housing for each phase. A vacuum interrupter respectively actuable by means of an energy store is provided in this housing for each phase. A drive mechanism for actuation of all movable contacts and all vacuum interrupters in the appropriate switching sequence is provided in a separate, lateral housing part. In this known tap changer, arranged on a phase plate for each phase separately are all fixed contacts and all movable contacts as well as the vacuum interrupters of this phase in common. Three insulated shafts extend through the housing and penetrate the three phase plates. The first insulated shaft actuates all movable selector contacts, the second insulated shaft actuates all movable preselector contacts and the third insulated shaft actuates all movable bypass contacts and all vacuum interrupters. The drive mechanism includes a single Geneva wheel, which is drivable by a Geneva driver connected with a drive shaft and which is connected with the first insulated shaft in such a way that when each switching-over process takes place the first insulated shaft is rotatable through an angle corresponding with a switching step. The drive mechanism includes first actuating means acting on the second insulated shaft and second actuating means acting on the third insulated shaft. The first actuating means consists of a roller on the Geneva wheel and a corresponding lever. In the case of a specific setting of the Geneva wheel the roller engages in a cut-out of the lever and the second insulated shaft is thereby pivotable through a defined angle of rotation. The second insulated shaft actuating the movable preselector contact is thus coupled to the drive shaft by way of the first actuating means, the Geneva wheel and the Geneva driver. Consequently, the first insulated shaft actuating the movable selector contacts and the second insulated shaft actuating the movable preselector contact are coupled in common to the drive shaft by way of the Geneva wheel and the Geneva driver.

Moreover, DE 197 43 864 C1 describes in FIG. 7 thereof the typical sequence of this tap changer in the case of switching over from one tap to an adjacent tap for a phase. The lefthand movable selector contact is connected in series with a lefthand switching-over impedance and forms a lefthand branch and the righthand movable selector contact is connected in series with a righthand switching-over impedance and forms a righthand branch. The vacuum interrupter is connected between the two branches and the corresponding connection with the load diverter line is produced by the bypass contacts. In the case of the stationary switching position according to FIG. 7*a*, the two movable selector contacts lie at the same, lefthand tap, i.e. at the same, lefthand fixed selector contact. In the case of the next stationary switching position according to FIG. 7*f* after a complete load changeover, the lefthand movable selector contact lies at the lefthand fixed selector contact and the righthand movable selector contact lies at the adjacent righthand fixed selector contact. This sequence repeats in each further load changeover process.

SUMMARY

According to an embodiment of the present invention, a method is provided that switches an on-load tap changer, which includes: a fine selector, which includes: selector fixed contacts having a commutation contact, which is connectable with a main winding of a regulating transformer, and tap contacts, which are respectively connectable with an associated tap of a regulating winding of the regulating transformer; a first selector arm, which is configured to selectably contact each of the selector fixed contacts; and a second selector arm, which is configured to selectably contact each of the selector fixed contacts; a preselector, which is switchable over from a first setting to a second setting, and conversely, which is connectable with the regulating winding and the main winding, and which includes: a first preselector fixed contact, a second preselector fixed contact, and a third preselector fixed contact, which is connected in the first setting with the first preselector fixed contact, and in the second setting, connected with the second preselector fixed contact; and a load changeover switch, which is switchable over from a first changeover setting to a second changeover setting, and conversely, and which includes: a first terminal connected with the first selector arm, a second terminal connected with the second selector arm, and a diverter line connected in the first changeover setting with the first terminal and in the second changeover setting with the second terminal. The method includes, when the preselector is to be switched over, then: the first selector arm and the second selector arm are set in such a way that one of the first selector arm or the second selector arm contacts the commutation contact and the other one of the first selector arm or the second selector arm does not contact any of the tap contacts, and switching over of the load changeover switch begins before switching over of the preselector has ended.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following:

FIGS. 9*a-h* how the individual switching phases of a first form of embodiment of a switching sequence of a tap switching action of the on-load tap changer in the regulating transformer of FIG. 9;

DETAILED DESCRIPTION

Figure 1:
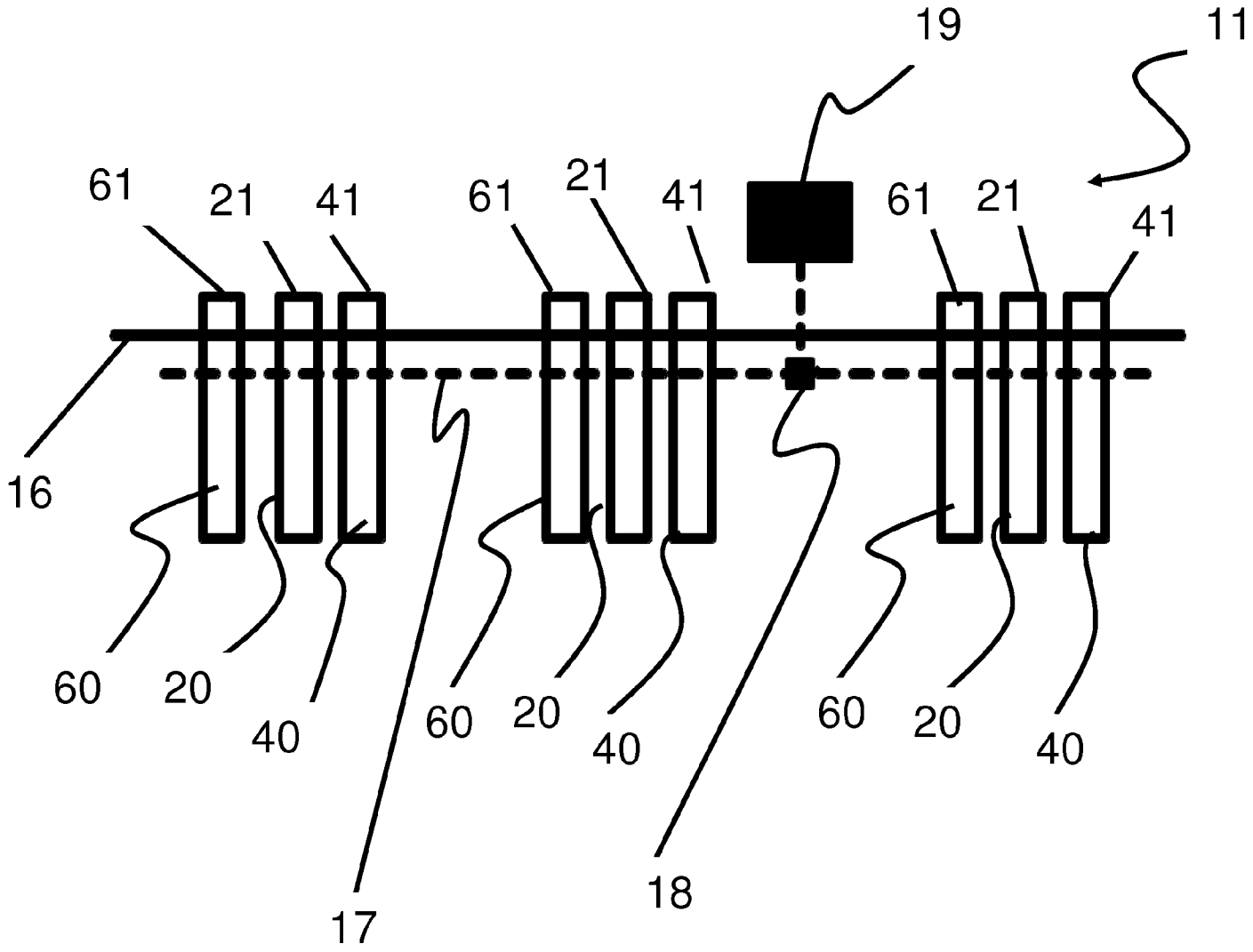
FIG. 1 shows a schematic side view of a preferred form of embodiment of an on-load tap changer with a fine selector, a preselector and a load changeover switch.

In the following, an expression of the kind "A is coupled to B" corresponds with an expression of the kind "A is connected with B", an expression of the kind "A is connected with B" embraces the meanings "A is directly electrically conductively connected with B" and "A is indirectly electrically conductively connected, thus by way of C, with B" and an expression of the kind "A is attached to B" has the meaning "A is directly electrically conductively connected with B".

According to a first aspect, the invention provides a method for switching an on-load tap changer, where the on-load tap changer includes:

- a fine selector which includes:
  - a plurality of selector fixed contacts including a commutation contact, which can or is to be connected with an associated tap of a main winding of a regulating transformer, and a plurality of tap contacts, which can be respectively connected with an associated tap of a regulating winding of the regulating transformer;
  - a first selector arm which can selectably contact each of the selector fixed contacts; and
  - a second selector arm which can selectably contact each of the selector fixed contacts;
- a preselector which can or is to be switched over from a first setting to a second setting and conversely and which can or is to be connected with the regulating winding and the main winding and includes:
  - a first preselector fixed contact,
  - a second preselector fixed contact, and
  - a third preselector fixed contact which is connected in the first setting with the first preselector fixed contact and in the second setting with the second preselector fixed contact; and
- a load changeover switch which can be switched over from a first setting to a second setting and conversely and which includes:
  - a first terminal connected with the first selector arm,
  - a second terminal connected with the second selector arm, and
  - a diverter line connected in the first setting with the first terminal and in the second setting with the second terminal;

where:

- when the preselector is or has to be switched over then:
  - the selector arms are set in such a way that one of the selector arms contacts the commutation contact and the other selector arm does not contact any of the tap contacts, and
  - switching over of the load changeover switch begins before switching over of the preselector has ended.

By this switching-over of the load changeover switch, there is meant here that which takes place when the preselector is or has to be switched over. This is to be seen in contrast to the 'normal' switching-over of the load changeover switch under load, which is also termed load switching over. In this load switching-over action the selector arms contact different selector fixed contacts, and thus, lie at different potentials and the current path leading from the regulating winding to the diverter line changes without interruption from one to the other selector arm. Since this change is to take place free of interruption, typically both selector arms are connected at least temporarily with the diverter line so that due to the different potentials present thereat a circular current flows through them, the load changeover switch, and the regulating winding.

Consequently, according to a method of the present invention, the selector arms during these changeovers of the load changeover switch and of the preselector are set in such a way that one of the selector arms contacts the commutation contact and the other selector arm does not contact any of the tap contacts. During these changeovers, for example, one of the selector arms can contact the commutation contact and the other selector arm can be disposed in an intermediate setting between the commutation contact and one of the tap contacts, but both selector arms can also contact the commutation contact. Moreover, during these changeovers the selector arms can, for example, change their respective setting as long as the stated condition that one contacts the commutation contact and the other contacts none of the tap contacts is fulfilled.

The preselector is (or is to be) switched over, for example, when the on-load tap changer obtains from a control device coupled thereto a switching command to execute tap switching from the currently set start setting to a target setting and when a) the start setting belongs to one of the setting regulation ranges, for example to the lower or upper setting regulation range, and the target setting belongs to another one of the setting regulation ranges, for example to the upper or lower setting regulation range, or when b) the start setting is the middle setting and the target setting belongs to one of the setting regulation ranges, or when c) the target setting is the middle setting and the start setting belongs to one of the setting regulation ranges.

This method enables the preselector and load changeover switch to be actuated at the same time at least for a defined time segment. As a result, the additional expenditure of time and control outlay for actuation of the preselector are saved, which significantly simplifies and accelerates the overall switching-over process, which is required for tap change, of the on-load tap changer. However, this method also enables the switching-over of the load changeover switch to end before the switching-over of the preselector begins and thus for load changeover switch and preselector to be actuated in succession.

The on-load tap changer can be constructed in any mode and manner according to requirements, for example in accordance with the second aspect.

Preferably, it is specified that:

switching-over of the load changeover switch takes place during switching-over of the preselector; and/or switching-over of the load changeover switch takes place exactly once; and/or during the switching-over of the preselector from the first setting to the second setting the load changeover switch is switched over from the second setting to the first setting and conversely.

Preferably, it is specified that:

during the switching-over of the load changeover switch there is no flow of circular current.

This can be achieved, for example, in that one of the selector arms contacts the commutation contact and the other selector arm does not contact any of the tap contacts.

Preferably, it is specified that:

the preselector includes:

a preselector moved contact able to adopt a first setting in which it contacts the first preselector fixed contact, a second setting in which it contacts the second preselector fixed contact and an intermediate setting in which it does not contact either of the preselector fixed contacts;

for switching-over of the preselector from the second to the first setting:

in a step a) the preselector moved contact is moved from the second setting to the intermediate setting;

in a step b) the load changeover switch is switched over;

in a step c) the preselector moved contact is moved from the intermediate setting to the first setting;

and conversely.

Consequently, for reversed switching-over of the preselector, thus from the first to the second setting, in a step a') the preselector moved contact is moved from the first setting to the intermediate setting;

in a step b') the load changeover switch is switched over; and in a step c') the preselector moved contact is moved from the intermediate setting to the second setting.

The preselector moved contact can be constructed in any mode and manner according to requirements, for example as a contact finger in a housing.

Step a) can, for example, be started before or simultaneously with or after the start of step b). Step c) can, for example, be ended simultaneously with or after the start of step b) and/or before or simultaneously with or after the end of step b).

Step a') can, for example, be started before or simultaneously with or after step b'). Step c') can, for example, be ended simultaneously with or after step b') and/or before or simultaneously with or after the end of step b').

Preferably, it is specified that the load changeover switch includes:

a movable switching-over contact able to adopt a first setting in which it contacts the first terminal, a second setting in which it contacts the second terminal and a bridging setting in which it contacts both terminals;

in step b) the switching-over contact is switched from the first setting to the bridging setting and thereafter from the bridging setting to the second setting; and in step b') the switching-over contact is switched from the second setting to the bridging setting and thereafter from the bridging setting to the first setting.

The switching-over contact can be constructed in any mode and manner according to requirements, for example like the movable middle contact of a rotary switch in which the movable middle contact is rotated or like the movable middle contact of a pull switch in which the movable middle contact is pulled or pressed.

Preferably, it is specified that the load changeover switch includes a switch connected between the terminals;

a resistance connected between the second terminal and the second selector arm; and the switch is closed during step b) and step b').

The switch can be constructed in any mode and manner according to requirements, for example as a semiconductor switch or as a vacuum interrupter.

The load changeover switch can be constructed in any mode and manner according to requirements and, for example, include no or at least one additional switch and/or no or at least one additional resistance.

According to a second aspect the invention provides an on-load tap changer for a regulating transformer, including:

a fine selector which includes:

a plurality of selector fixed contacts including a commutation contact, which can or is to be connected with a main winding of a regulating transformer, and a plurality of tap contacts, which can or are to be respectively connected with an associated tap of a regulating winding of the regulating transformer;

a first selector arm which can selectably contact each of the selector fixed contacts; and a second selector arm which can selectably contact each of the selector fixed contacts;

a preselector which can be switched over from a first setting to a second setting and conversely and which can or is to be connected with the regulating winding and the main winding and includes:

a first preselector fixed contact, a second preselector fixed contact, and a third preselector fixed contact which is connected in the first setting with the first fixed contact and in the second setting with the second preselector fixed contact;

a load changeover switch which can be switched over from a first setting to a second setting and conversely and which includes:

a first terminal connected with the first selector arm, a second terminal connected with the second selector arm, a diverter line connected in the first setting with the first terminal and in the second setting with the second terminal, and a common drive shaft for the preselector, the fine selector and the load changeover switch, where the preselector, the fine selector and the load changeover switch are each separately coupled to the drive shaft.

The separate coupling makes possible a simple and robust construction as well as a flexible and easy adaptation of the on-load tap changer and a significantly simplified and accelerated switching-over process of the on-load tap changer and thereby fault-free functioning.

Preferably, it is specified that the preselector includes:

a preselector moved contact able to adopt a first setting in which it contacts the first preselector fixed contact, a second setting in which it contacts the second preselector fixed contact and an intermediate setting in which it contacts neither of the preselector fixed contacts.

Preferably, the load changeover switch includes:

a movable switching-over contact able to adopt a first setting in which it contacts the first terminal, a second setting in which it contacts the second terminal and a bridging setting in which it contacts both terminals.

Preferably, the load changeover switch includes:

a switch connected between the terminals; and a resistance connected between the second terminal and the second selector arm.

Preferably, it is specified that:

the preselector includes:

a preselector base plate with a first side and a second, opposite side;

a preselector driver on the first side, which driver is seated on the drive shaft to be secure against relative rotation and carries a first preselector entrainer;

a preselector Geneva wheel on the first side, which wheel is rotatably mounted on the preselector base plate and carries a second preselector entrainer;

a rocker on the first side, which rocker is pivotably mounted on the preselector base plate and has a mouth for the second entrainer;

the drive shaft extends through the preselector base plate and is rotatably mounted thereon;

the preselector fixed contacts and the preselector moved contact are arranged on the second side of the preselector base plate;

the rocker is connected with the preselector moved contact to be secure against relative rotation;

the first entrainer so co-operates with the preselector Geneva wheel that in the case of a complete revolution of the preselector driver the preselector Geneva wheel rotates through only a fraction of a complete revolution, where this fraction corresponds with a switching process of the fine selector from one selector fixed contact to an adjacent selector fixed contact;

the second entrainer so co-operates with the rocker that when one of the selector arms contacts one of the tap contacts the second entrainer in the case of rotation of the preselector Geneva wheel through the fraction does not engage in the mouth and when one of the selector arms contacts the commutation contact and the other selector arm does not contact any of the tap contacts the second entrainer so engages in the mouth that the preselector moved contact is switched over.

Preferably, it is specified that:

the preselector fixed contacts are led from the first side through the preselector base plate to the second side.

The preselector serves the purpose of connecting the regulating winding in different ways with the main winding and can be constructed in any mode and manner according to requirements, for example as a reversing switch or coarse selector or multiple coarse selector.

Preferably, it is specified that:

the preselector is constructed as a reversing switch;

the first preselector fixed contact can or is to be connected with an end of the regulating winding;

the second preselector fixed contact can or is to be connected with a second end of the regulating winding; and the third preselector fixed contact can or is to be connected with the main winding.

Preferably, and particularly in this case, it is to be specified that:

the third preselector fixed contact is constantly connected with the commutation contact.

Preferably, it is specified that:

the preselector is constructed as a coarse selector;

the first preselector fixed contact can or is to be be connected with a first end of the main winding;

the second preselector fixed contact can or is to be connected with a tap of the main winding; and the third preselector fixed contact can or is to be connected with an end of the regulating winding.

Preferably, and particularly in this case, it is specified that:

the first preselector fixed contact is constantly connected with the commutation contact.

Preferably, the on-load tap changer includes:

a first coupling device coupling the preselector to the drive shaft; and a second coupling device coupling the fine selector to the drive shaft;

where the coupling devices are constructed separately from one another and/or have no common components.

Preferably, the on-load tap changer includes:

a third coupling device coupling the load changeover switch to the drive shaft;

where the third coupling device and the first and/or second coupling device are constructed separately from one another and/or have no common components.

The first coupling device can be constructed in any mode and manner according to requirements and can include, for example, the preselector driver, the preselector Geneva wheel and the rocker.

According to a third aspect the invention provides a regulating transformer including:

a main winding;

a regulating winding with a plurality of taps; and an on-load tap changer constructed in accordance with the second aspect;

where:

the commutation contact is connected with the main winding and the tap contacts are each connected with an associated tap of the regulating winding; and the preselector is connected with the regulating winding and the main winding.

By way of example, one of the proposed methods can be performed by any of the proposed on-load tap changers and by any of the proposed regulating transformers.

Each of the proposed tap changers and each of the proposed regulating transformers can, for example, be constructed in such a way and/or serve such a purpose and/or be suitable for such a purpose that they execute and/or can execute one of the proposed methods.

The explanations with respect to one of the aspects of the invention, particularly to individual features of this aspect, correspondingly also apply in analogous manner to the other aspects of the invention.

Forms of embodiment of the invention are explained in more detail in the following by way of example with reference to the accompanying drawings. However, the individual features evident therefrom are not restricted to the individual forms of embodiment, but can be connected and/or combined with further above-described individual features and/or with individual features of other forms of embodiment. The details in the drawings are merely explanatory and are not to be understood as limiting. The reference numerals contained in the claims are not to restrict the scope of protection of the invention in any way, but refer merely to the forms of embodiment shown in the drawings.

Figure 9:
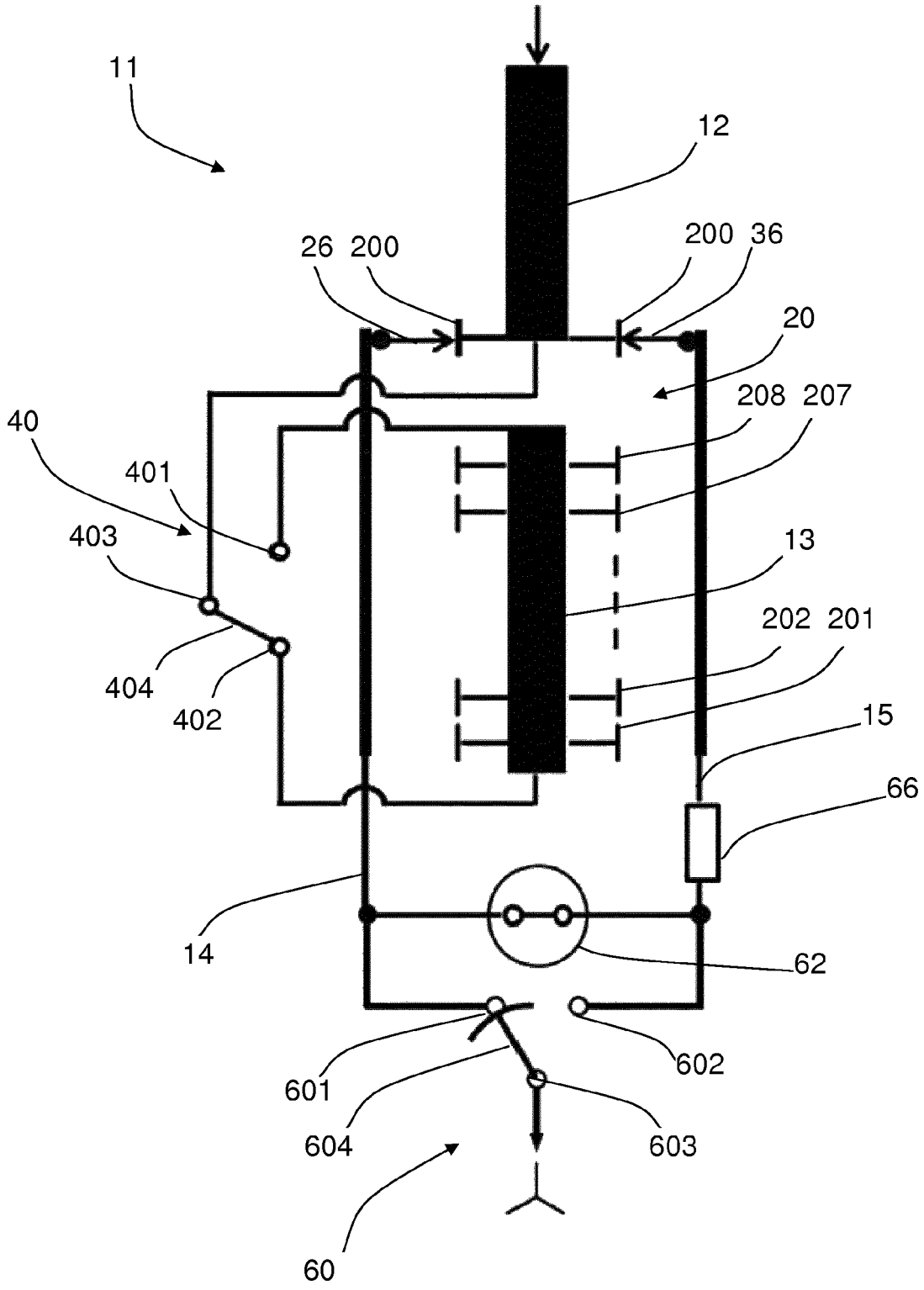
FIG. 9 shows a switching plan for a first form of embodiment of a regulating transformer which includes the on-load tap changer of FIG. 1, where the on-load tap changer is disposed in its starting position.
Figure 9A:
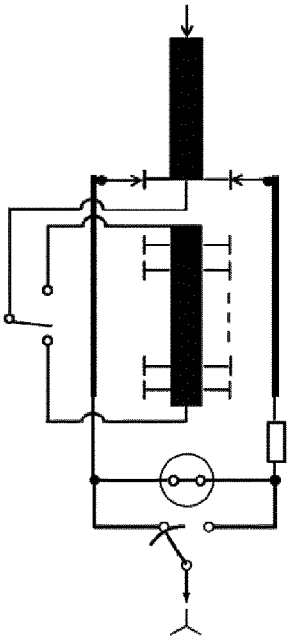
Figure 9A:
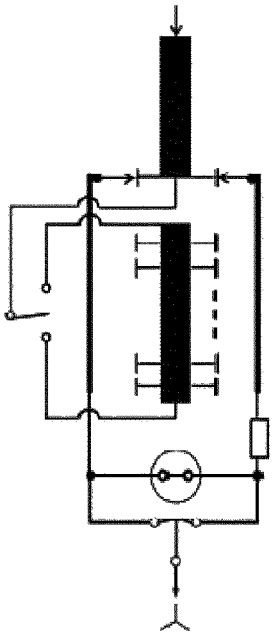
Figure 9A:
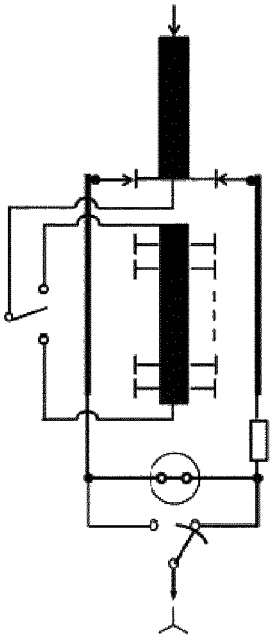
Figure 9A:
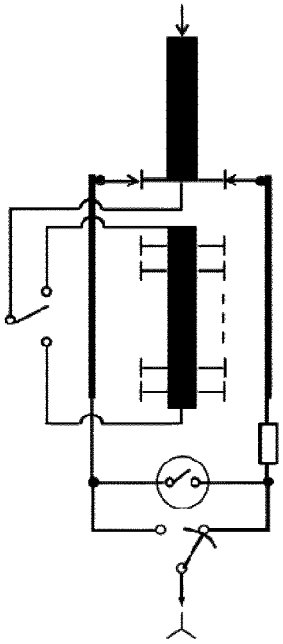
Figure 9C:
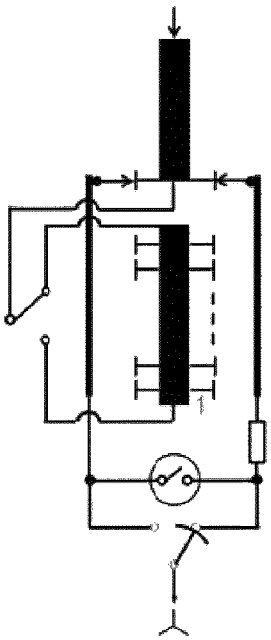
Figure 9D:
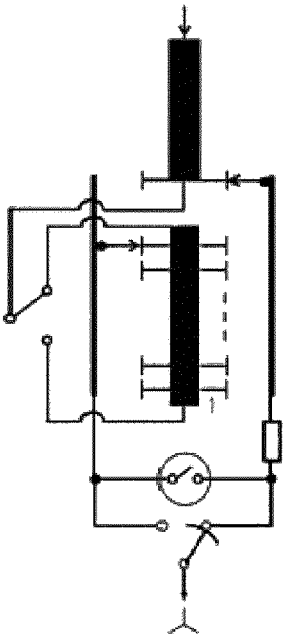
Figure 9E:
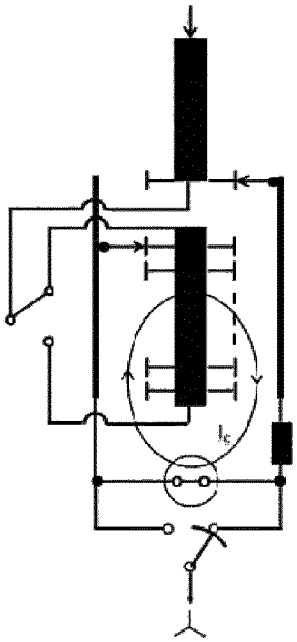
Figure 9E:
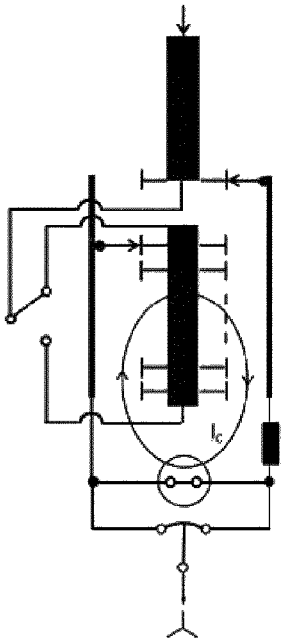
Figure 9E:
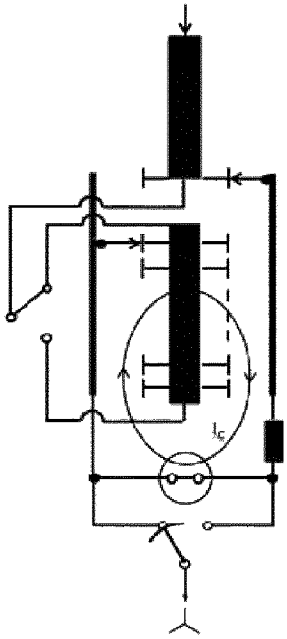
Figure 9E:
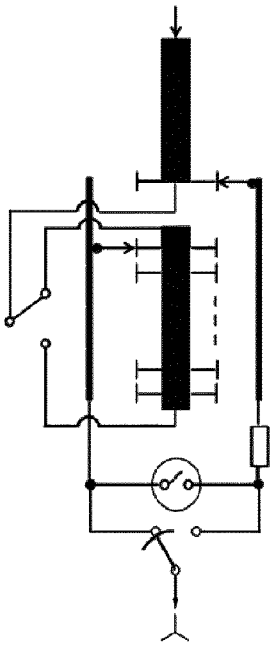
Figure 9G:
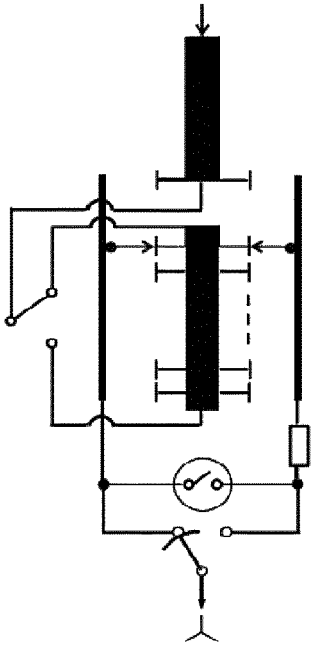

A preferred form of embodiment of an on-load tap changer 11 is schematically illustrated in FIG. 1. In this form of embodiment, the on-load tap changer 11 is constructed in accordance with the resistance principle and includes three fine selectors 20, three preselectors 40 and three load changeover switches 60. Each fine selector 20, each preselector 40 and each load changeover switch 60 is associated with a specific phase of a regulating transformer 10 (FIG. 9). A single-phase variant of the on-load tap changer 11 would thus include only one fine selector 20, one preselector 40 and one load changeover switch 60. Each fine selector 20 is mounted on a fine selector base plate 21, each preselector 40 on a preselector base plate 41 and each load changeover switch 60 on a load changeover switch base plate 61. The individual base plates 21, 41, 61 preferably consist of an insulating material such as, for example, plastic or fibre-reinforced plastic (for example, a mixture of polyamide or polyphthalamide with glass fibres). They are individually pushed onto at least one rod 16 and are held by way of this. The fastening of the plates 21, 41, 61 can also be carried out in other ways, for example by way of spacers, webs injection-moulded thereon or further plates. A common drive shaft 17 drives all fine selectors 20, preselectors 40 and load changeover switches 60. In this form of embodiment the drive shaft 17 extends through the plates 21, 41, 61. The drive shaft 17 is preferably driven by a motor 19 by way of a bevel gear transmission 18, but can also be directly driven by the motor 19, thus without an interposed transmission.

Figure 2:
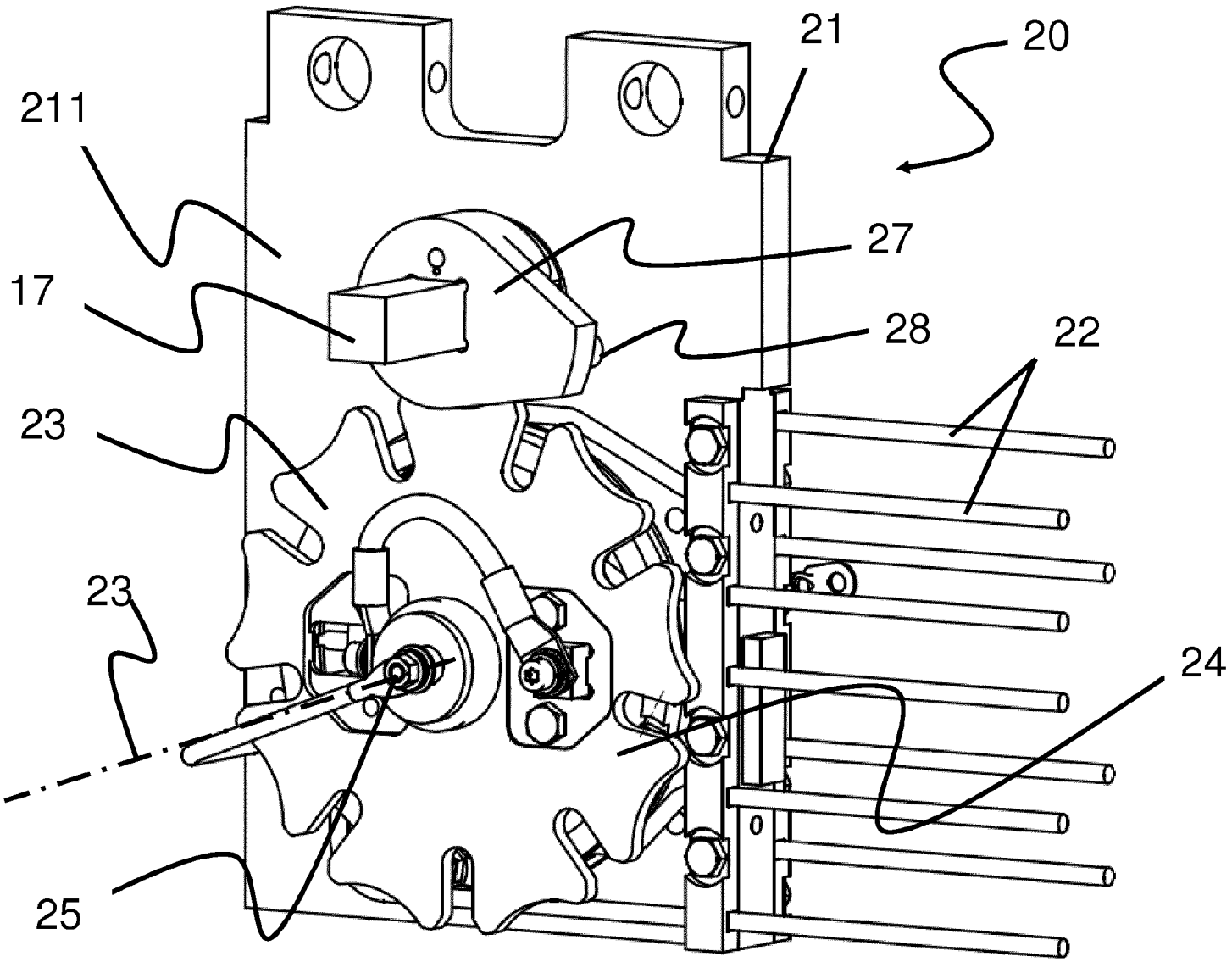
FIG. 2 shows a first side of a preferred form of embodiment of a fine selector for the on-load tap changer of FIG. 1.
Figure 3:
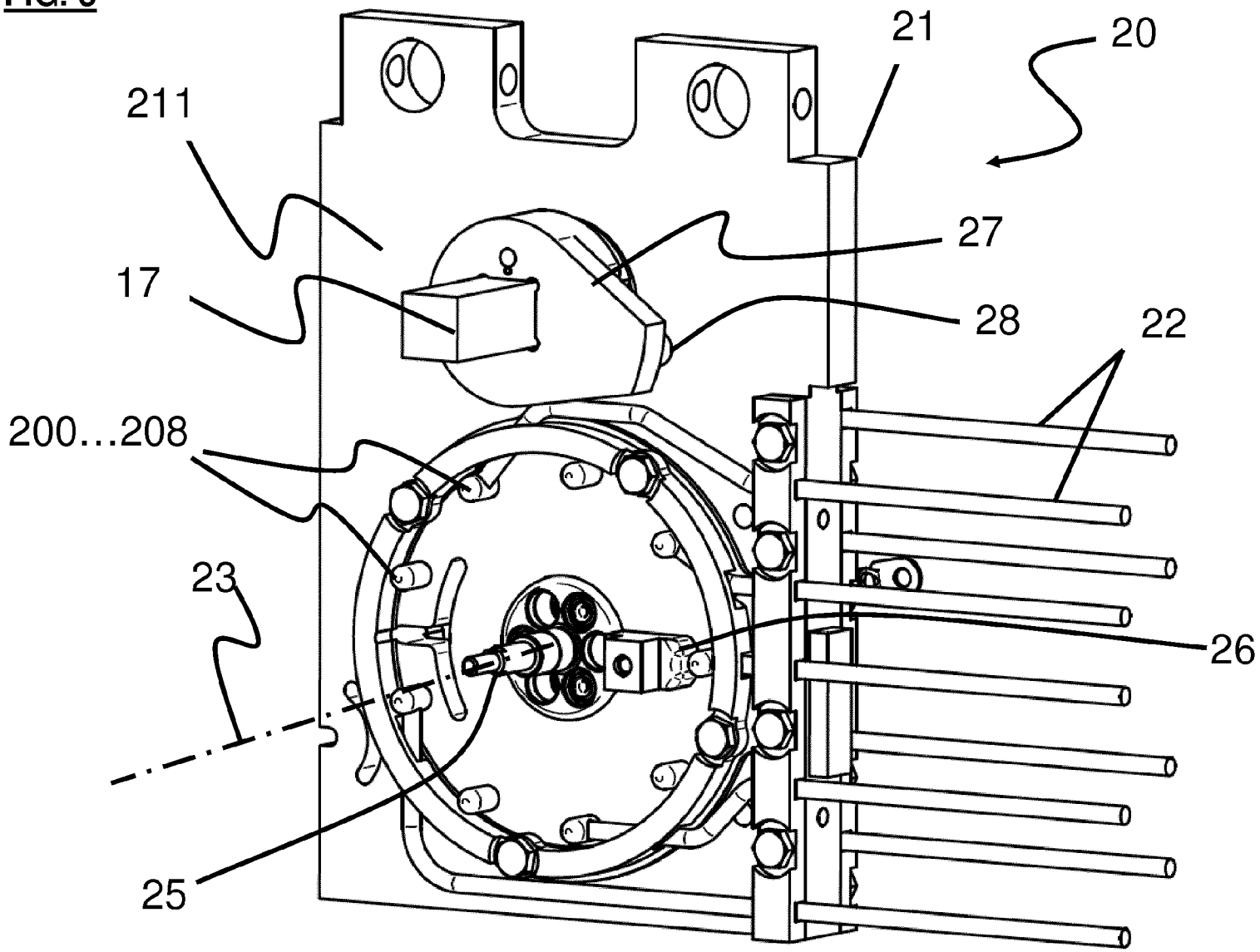
FIG. 3 shows the first side of the fine selector of FIG. 2 with removed Geneva wheel.
Figure 4:
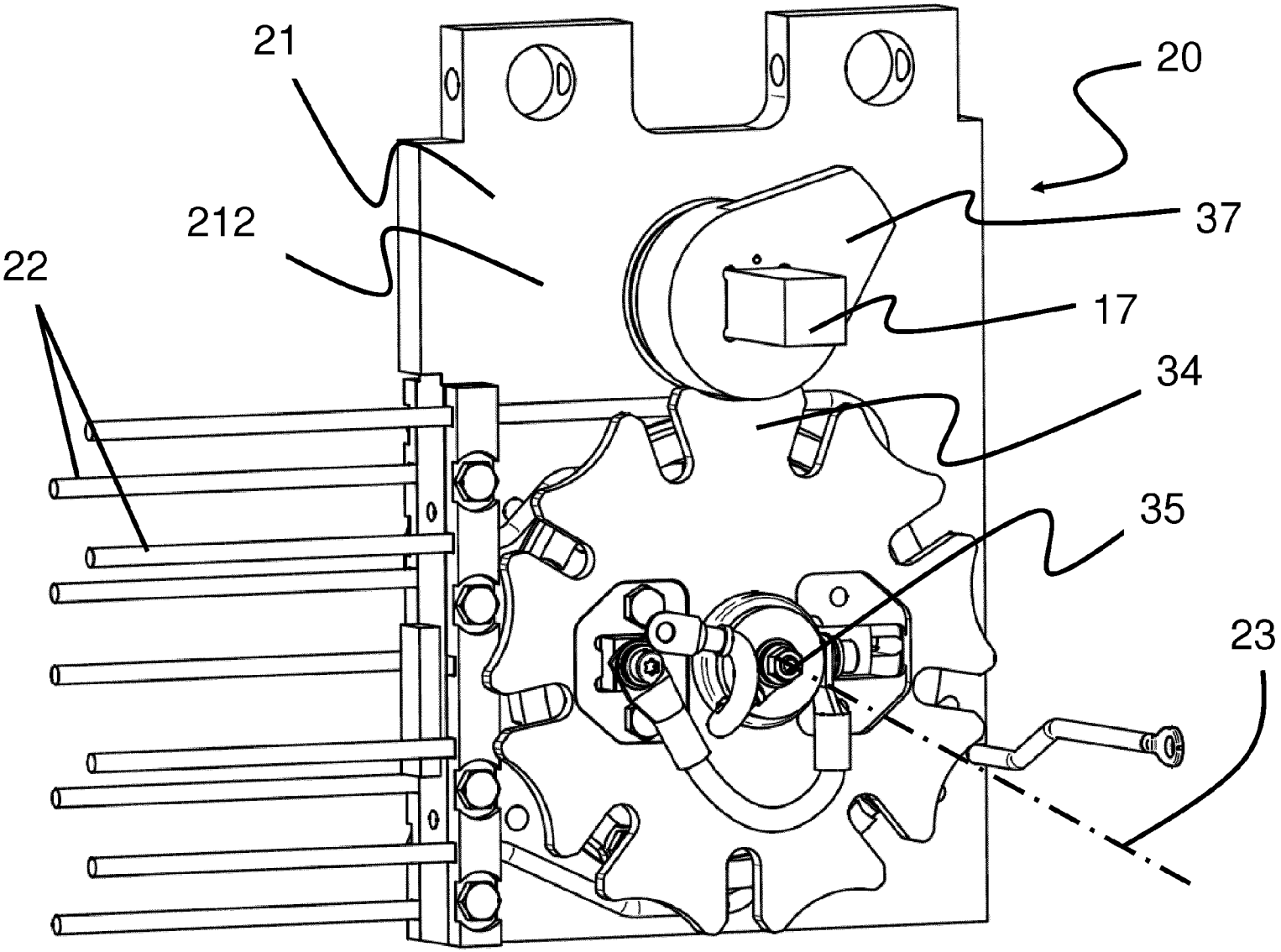
FIG. 4 shows a second side of the fine selector.

One of the fine selectors 20, which is constructed in accordance with a preferred form of embodiment, is illustrated in FIG. 2, FIG. 3 and FIG. 4. The fine selector base plate 21 has a first side 211 and a second, opposite side 212. FIGS. 2 and 3 show the first side 211, on which nine selector fixed contacts 200 . . . 208 (FIG. 3) are arranged behind a first selector Geneva wheel 24. Five of these nine selector fixed contacts 200 . . . 208 are connected with five lines 22, by way of which they can be connected with associated taps of a regulating winding 11 of the regulating transformer 10. The selector fixed contacts 200 . . . 208 extend from the first side 211 through the fine selector base plate 21 to the second side 212. The selector fixed contacts 200 . . . 208 preferably consist of copper and are, in addition, silvered. The first selector Geneva wheel 24 carries a first, radially movably mounted selector arm 26 at its rear side facing towards the fine selector base plate 21 and is mounted on a first bearing axle 25 to be rotatable about an axis 23. The bearing axle 25 is constructed as a separate part mechanically connected with the fine selector plate 21. However, the bearing axle 25 can during production of the fine selector base plate 21 be injection-moulded thereon and be constructed therewith as a unit. Apart from the first selector Geneva wheel 24, a first selector driver 27, which is driven by way of the drive shaft 17, is provided. In that case, the first selector driver 27 includes a first selector entrainer 28 which engages in the first selector Geneva wheel 24 and in that case rotates this.

When the fine selector 20 is actuated, the first selector driver 27 rotates through 360°. On co-operation with the first selected Geneva wheel 24 the first selector Geneva wheel 24 is rotated only to a partial extent when this complete revolution of the first selector driver 27 takes place, thus is rotated through a fraction of a complete revolution. Through the combination of the first selector driver 27 and the first selector Geneva wheel 24 the continuous rotational movement of the first selector driver 27 is converted into a stepped or partial rotation of the first selector Geneva wheel 24. The combination of Geneva wheel and driver also makes possible a blocking function of the two parts relative to one another also in the rest state, thus prior to or after actuation of the fine selector 20.

FIG. 4 shows the second side 212 of the fine selector base plate 21. A second selector Geneva wheel 34 with a second selector arm 36 (not illustrated) is mounted on the second side 212 analogously to the first side 211. The second selector Geneva wheel 34 is similarly mounted on a second bearing axle 35 to be rotatable about the axis 23. A second selector driver 37 is arranged near the second selector Geneva wheel 34 and is actuated by the same drive shaft 17 as the first selector driver 27. In that case, the second selector driver 37 includes a second selector entrainer 38 which engages in the second selector Geneva wheel 34 and in that case rotates this. The second selector Geneva wheel 34 and thus the second selector arm 36 are driven in steps by the drive shaft 17 by way of the second selector driver 37 analogously to the first selector Geneva wheel 34 and the second selector arm 36.

The nine selector fixed contacts 200 . . . 208 (not illustrated) are arranged behind the second selector Geneva wheel 34 analogously to the first side 211. The remaining four selector fixed contacts, which are not connected on the first side 211 with the five lines, are connected with four further lines 22 by way of which they can be connected with associated taps of the regulating winding 11.

Figure 5:
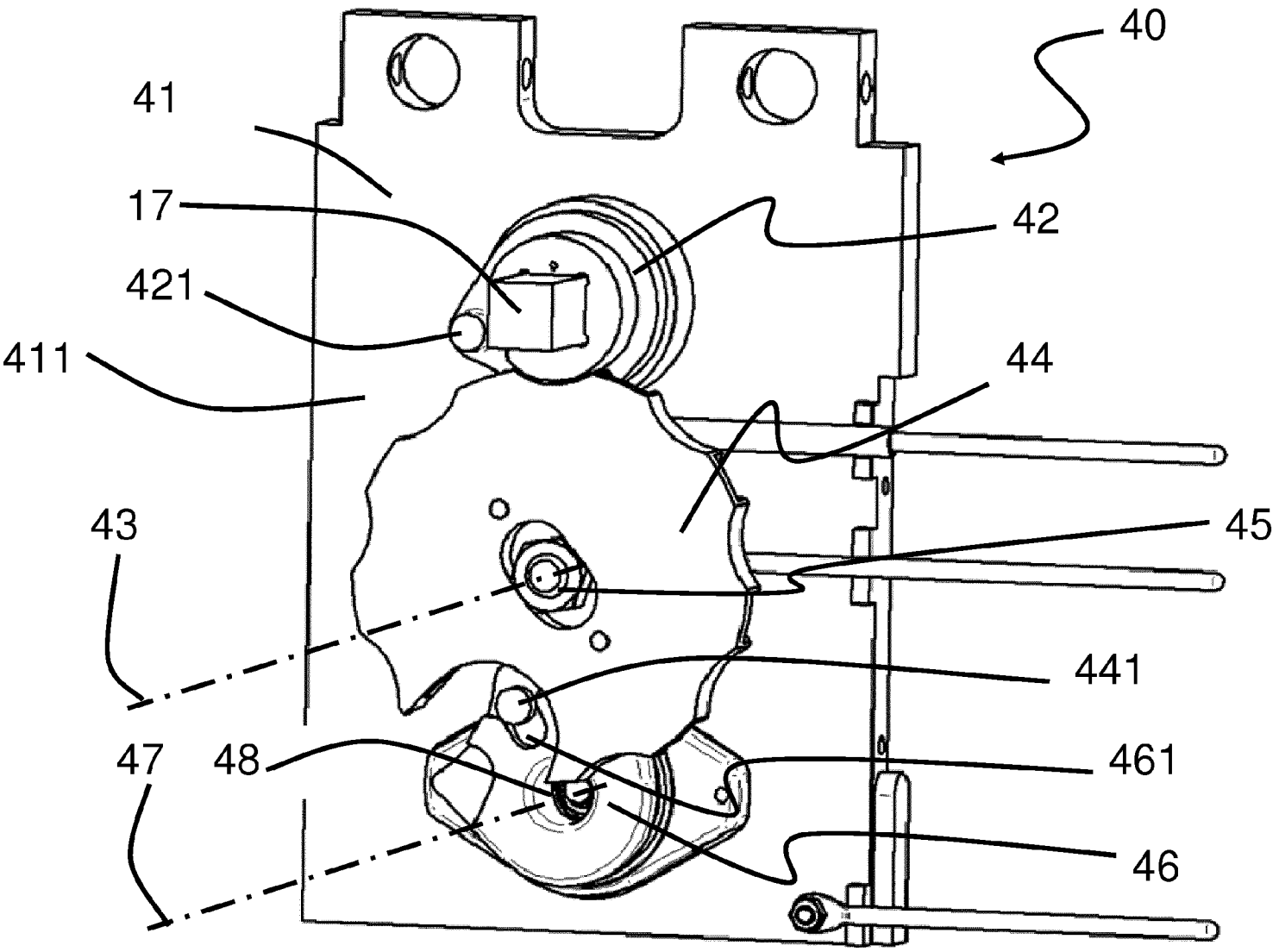
FIG. 5 shows a first side of a preferred form of embodiment of a preselector for the on-load tap changer of FIG. 1 with partly cut-away Geneva wheel.
Figure 6:
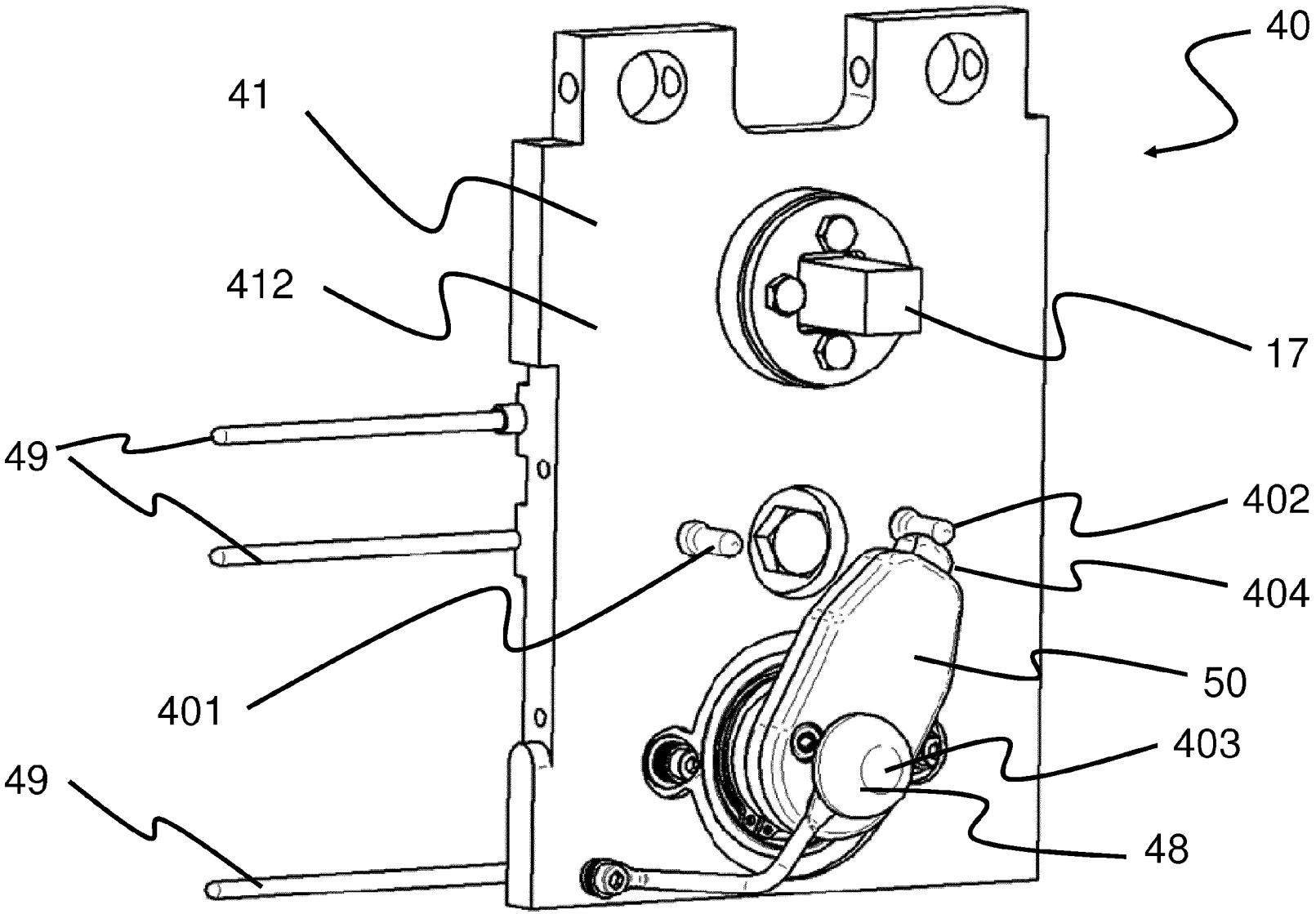
FIG. 6 shows a second side of the preselector.

One of the preselectors 40 is illustrated in FIGS. 5 and 6, this preselector being constructed in accordance with a preferred form of embodiment. The preselector base plate 41 has a first side 411 and a second, opposite side 412. FIG. 5 shows the first side 411. Mounted on this is a preselector Geneva wheel 44 which is mounted on a first bearing axle 45 to be rotatable about a first axis 43. The first bearing axle 45 is constructed as a separate part mechanically connected with the preselector base plate 41. However, the first bearing axle 45 can at the time of production of the preselector base plate 41 be injection moulded thereon and be constructed as a unit therewith. Arranged near the preselector Geneva wheel 44 is a preselector driver 42, which is seated on the drive shaft 17 to be secure against relative rotation. The first preselector driver 42 includes a first preselector entrainer 421 which can engage in the preselector Geneva wheel 44 and in that case rotates this in steps. Moreover, a rocker 46 mounted on a second bearing axle 48 to be pivotable about a second axis 47 is mounted on the first side 411. The second bearing axle 48 is similarly constructed as a separate part mechanically connected with the preselector base plate 41. However, the second bearing axle 48 can at the time of production of the preselector base plate 41 be injection moulded thereon and be constructed as a unit therewith. The rocker 46 has a mouth 461 co-operating with a second preselector entrainer 441 which projects from the rear side, which faces the preselector base plate 41 of the preselector Geneva wheel 44.

FIG. 6 shows the second side 412 of the selector base plate 41. A first preselector fixed contact 401, a second preselector fixed contact 402 and a third preselector fixed contact 403 of the preselector 40 are arranged thereon. The first and second preselector fixed contacts 401, 402 are led from the first side 411 through the preselector base plate 41 to the second side 412 and connected with lines 49 by way of which they can be connected with the ends of the regulating winding 13. The third preselector fixed contact 403 can be connected with a main winding 12 of the regulating transformer 10 by way of a line 49, which is led from the first side 411 through the preselector base plate 41 to the second side 412. The preselector fixed contacts 401 . . . 403 preferably consist of copper and are additionally silvered. Moreover, the second side 412 includes a preselector moved contact 404, which is resiliently mounted in a contact housing 50. The contact housing 50 is fixedly connected with the bearing axle 48 so that the pivot movement of the rocker 46 is transmitted to the preselector moved contact 404. In the first setting this contacts the first preselector fixed contact 401, in the second setting it contacts the second preselector fixed contact 402 and in the intermediate setting contacts neither of these two contacts.

For actuation of the preselector 40 the preselector driver 42 is rotated by the drive shaft 17 through 360°. In that case, the first preselector entrainer 421 in each complete revolution of the preselector driver 42 engages in the preselector Geneva wheel 44 and moves this through a fraction of a full revolution. This fraction corresponds with a switching process of the fine selector 20 from one selector fixed contact 200 . . . 208 to an adjacent selector fixed contact 200 . . . 208. In these switching processes the rocker 46 remains uncontacted, since the second preselector entrainer 441 has still not reached the position in which it engages in the mouth 461. Only when one of the two selector arms 26, 36 contacts the commutation contact 200 and the other one of the two selector arms 26, 36 does not contact any of the tap contacts 201 . . . 208 does the second preselector entrainer 441 engage in the mouth 461 and pivot the rocker 46. By way of the pivot movement of the rocker 46, the second bearing axle 48 is also pivoted and thus the contact housing 50 with the preselector moved contact 404. The preselector moved contact 404 is thereby switched from the first to the second setting or from the second to the first setting depending on the respective switching direction.

This preselector 40 can be selectably used as a reversing switch or coarse selector, depending on how it is connected with the regulating winding 13 and main winding 12.

Figure 7:
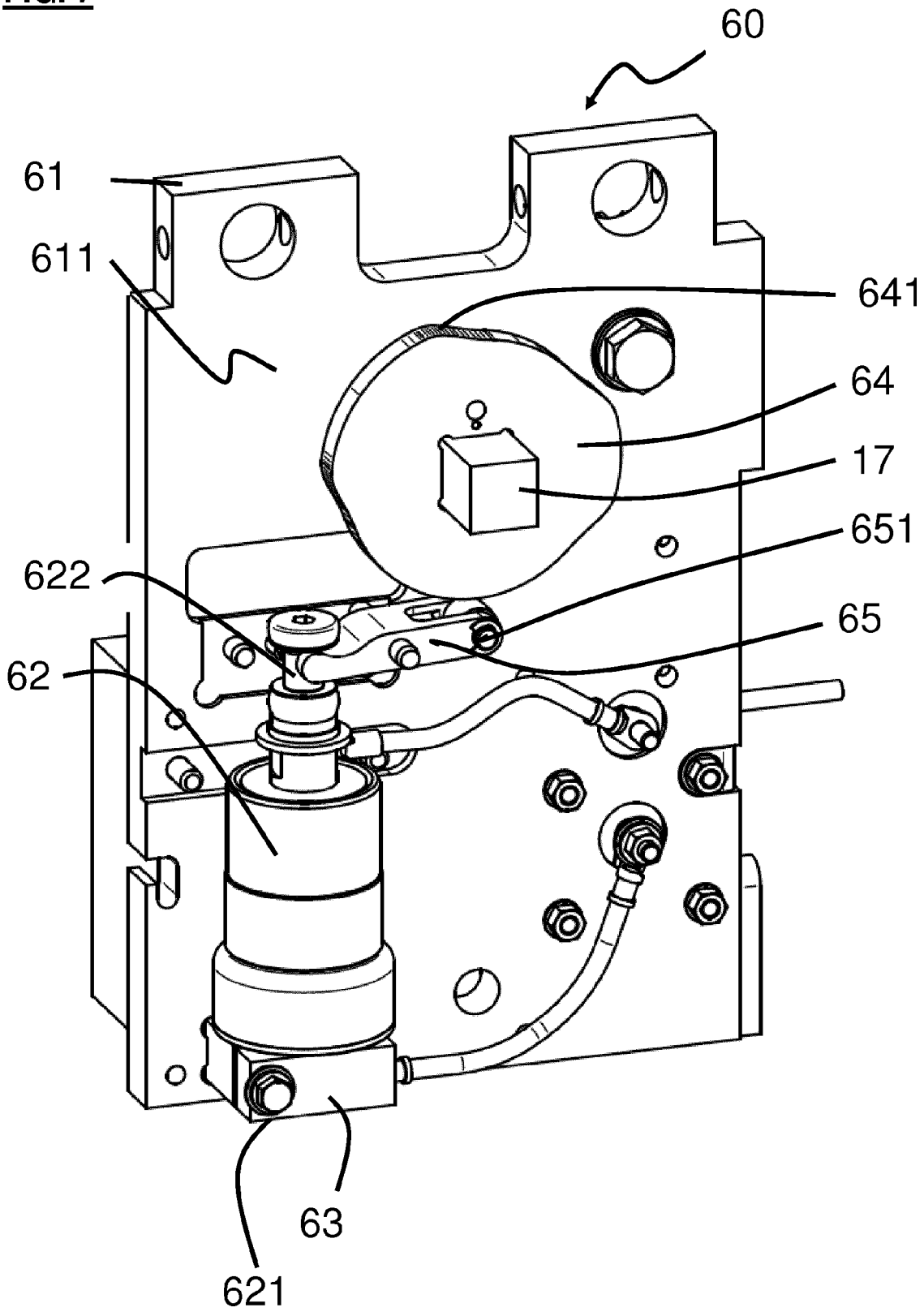
FIG. 7 shows a first side of a preferred form of embodiment of a load changeover switch for the on-load tap changer of FIG. 1.
Figure 8:
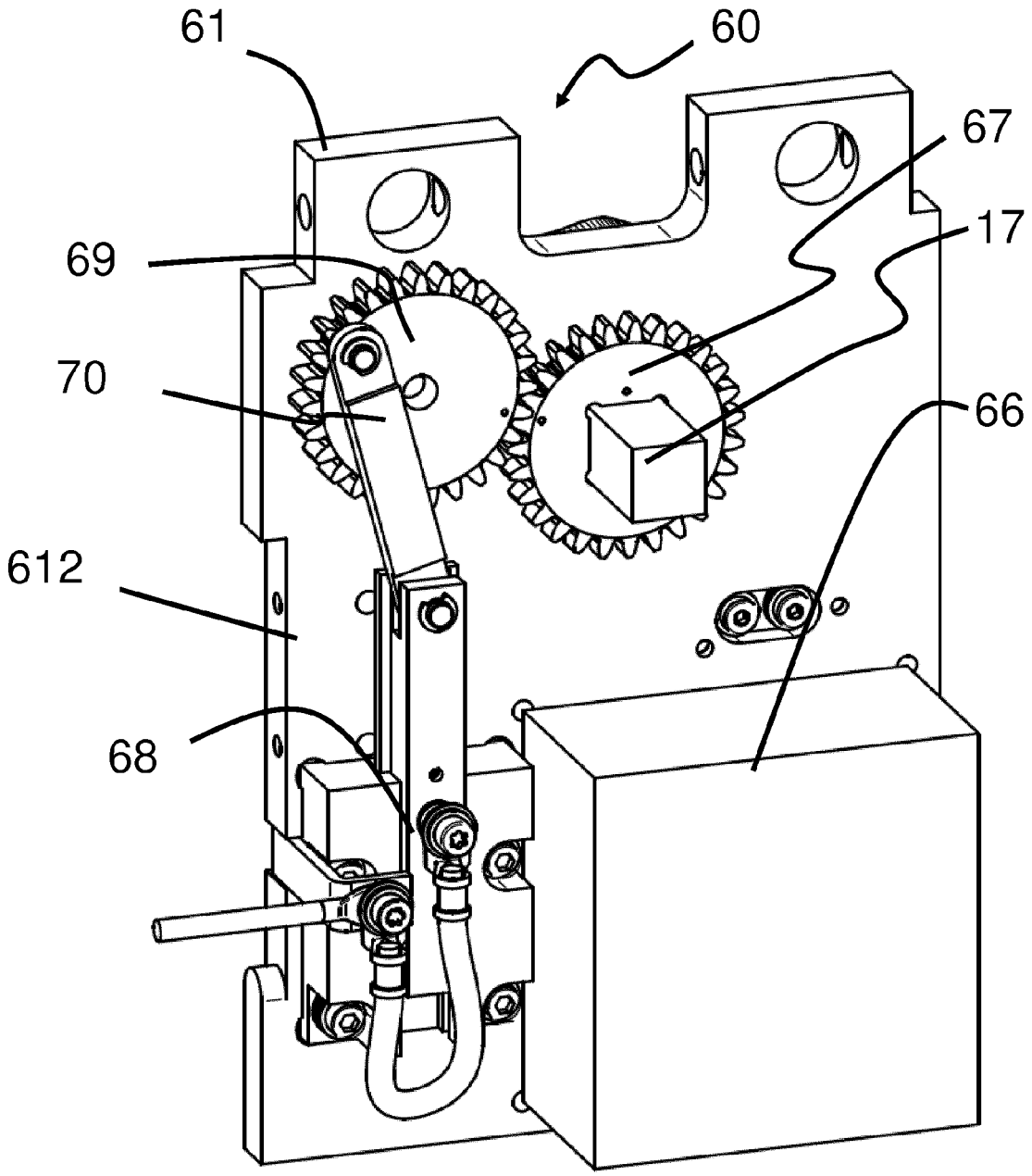
FIG. 8 shows a second side of the load changeover switch.

One of the load changeover switches 60, which is constructed in accordance with a preferred form of embodiment, is illustrated in FIG. 7 and FIG. 8. The load changeover switch base plate 61 preferably consists of an insulating material such as, for example, plastic or fibre-reinforced plastic (for example, a mixture of polyamide or polyphthalamide with glass fibres) and has a first side 611 and a second, opposite side 612. FIG. 7 shows the first side 611. A switch 62, which in this form of embodiment is constructed as a vacuum interrupter, is attached to the load changeover switch base plate 61 on the side 611 by means of holders 63. The vacuum interrupter 62 includes a fixed contact 621 and a moved contact 622, by way of which the vacuum interrupter 62 is opened or closed. In addition, a cam disc 64 is mounted on the drive shaft 17 on the first side 611 to be secure against rotation relative to the shaft. A rocker lever 65 is so rotatably mounted between the cam disc 64 and the moved contact 622 that on rotation of the cam disc 64 an end 651 of the rocker lever 65 travels over a profile 641 of the cam disc 64 and thereby actuates the vacuum interrupter 62, i.e. closes or opens it by way of the moved contact 622 thereof. The moved contact 622 is guided in a holder at the time of actuation.

FIG. 8 shows the second side 612 of the load changeover switch base plate 61. A resistance 66 is arranged on the second side 612. In addition, a first gearwheel 67, which co-operates with the cam disc 64 on the first side 611, is rotatably mounted on the second side 612. In the example shown here the drive shaft 17 passes through the cam disc 64, the load changeover switch base plate 61 and the first gearwheel 67 and drives the cam disc 64 and the first gearwheel 67. In addition, a switching element 68 is mounted on the second side 612, the switch element being driven by way of a combination of a second gearwheel 69, which meshes with the first gearwheel 67, and a connecting rod 70. Through actuation of the drive shaft 17 the switching element 68 is actuated by way of the gearwheels 67, 69 and the connecting rod 70. The rotational movement of the drive shaft 17 is thus here converted into a linear movement of the switching element 68. The switching element 68 is constructed as, for example, a bridging switch, but can also be constructed as, for example, a rotary switch.

The arrangement of the individual parts, particularly the vacuum interrupter 62, the resistance 66 and the switching element 68, can be distributed on the first side 611 and/or the second side 612 of the load changeover switch base plate 61 according to requirements. In addition, actuation of the vacuum interrupter 62 and the switching element 68 can be carried out according to requirements in any desired way, for example via gearwheels and/or Geneva wheels and/or connecting rods.

In this form of embodiment the on-load tap changer 11 includes a first coupling device coupling the preselector 40 to the drive shaft 17, a second coupling device coupling the fine selector 20 to the drive shaft 17 and a third coupling device coupling the load changeover switch 60 to the drive shaft 17. The first coupling device includes the preselector drive 42, the preselector Geneva wheel 44 and the rocker 46. The second coupling device includes the selector drivers 27, 37 and the selector Geneva wheels 24, 34. The third coupling device includes the cam disc 64, the rocker lever 65, the gearwheels 67, 69 and the connecting rod 70. These three coupling devices are consequently constructed separately from one another and have no common components.

A switching plan for a phase of a first embodiment of a three-phase regulating transformer 10, which includes the on-load tap changer 11 of FIG. 1 as well as a main winding 12 and a regulating winding 13 with a plurality of taps, is illustrated in FIG. 9. The commutation contact 200 is connected with one end of the main winding 12 and the tap contacts 201 . . . 208 are each connected with an associated tap of the regulating winding 13.

In this form of embodiment the preselector 40 is used as a reversing switch and serves the purpose of connecting the regulating winding 13 selectably in the same sense or opposite sense with the main winding 12. The first preselector fixed contact 401 is connected with a first end of the regulating winding 13, the second preselector fixed contact 402 is connected with a second end of the regulating winding 13 and the third preselector fixed contact 403 is connected with one end of the main winding 12 and constantly with the commutation contact 200.

In this form of embodiment the load changeover switch 60 includes, additionally to the switch 62 and the resistance 66, a first terminal 601, a second terminal 602 and a movable switching-over contact 604, which is connected with a diverter line 603 of the on-load tap changer 11 and the regulating transformer 10. The switching-over contact 604 is constructed as a bridging switch and in a first setting contacts the first terminal 601, in a second setting contacts the second terminal 602 and in a bridging setting contacts both terminals 601, 602. In that case, in the first setting this connects the diverter line 603 with the first terminal 601, in the second setting it connects the diverter line 603 with the second terminal 602 and in the bridging setting connects both terminals 601, 602 with the diverter line 603. The first terminal 601 is connected with the first selector arm 26 by way of a main branch 14. The second terminal 602 is connected with the second selector arm 36 by way of an auxiliary branch 15, in which case the resistance 66 is connected in series therebetween. The switch 62 is switched between the terminals 601 and 602.

A first form of embodiment of a switching sequence of a tap switching action of the on-load tap changer 11 is illustrated in FIG. 9 and FIGS. 9*a* to *h*. Through this tap switching action the on-load tap changer 11 switches, for example, from the commutation contact 200 to the eighth tap contact 208, which is also termed switching from a setting 9 to a setting 8 of the on-load tap changer 11. In setting 9 the selector arms 26, 36 contact the commutation contact 200 and the preselector 40 is disposed in the first setting. In setting 8 the selector arms 26, 36 contact the eighth tap contact 208 and the preselector 40 is disposed in the second setting. Consequently, the preselector 40 has to be actuated in this tap switching action.

The starting position for this switching sequence is illustrated in FIG. 9. In this starting position, the on-load tap changer 11 is disposed at setting 9 and the load changeover switch 60 in the first setting and the switch 62 is closed.

The preselector moved contact 404 is separated from the second preselector fixed contact 402 and thus brought into the intermediate setting in a step a. The on-load tap changer 11 is now disposed in the position of FIG. 9*a*.

The load changeover switch 60 is switched over in a step b. In that case, the switching-over contact 604 is initially moved into the bridging setting according to FIG. 9*b*1 and thereafter further into the second setting according to FIG. 9*b*2. The switch 62 is thereupon opened. A first switching-over of the load changeover switch 60 is thus concluded, during which no circular current has flowed. The preselector moved contact 404 is still in the intermediate setting on the way to the first preselector fixed contact 401. The on-load tap changer 11 is now in the position of FIG. 9*b*3.

The preselector moved contact 404 is contacted with the first preselector fixed contact 401 and thus brought into the second setting in a step c. The switching-over of the preselector 40 is thereby concluded. The on-load tap changer 11 is now in the position of FIG. 9*c*.

The switching steps required for completion of the tap switching to setting 8 now follow.

The first selector arm 26 is separated from the commutation contact 200 in a step d and contacted with the eighth tap contact 208. The on-load tap changer 11 is now in the position of FIG. 9*d*.

The switch 62 is closed in a step e so that the auxiliary branch 15 is connected with the main branch 14 by way of the switch 62 and a circular current Ic flows through the on-load tap changer 11 and the regulating winding 13. The on-load tap changer 11 is now in the position of FIG. 9*e*.

In a step f, the switching-over contact 604 is initially moved again into the bridging setting according to FIG. 9*f*1 and thereafter back to the first setting according to FIG. 9*f*2. The switch 62 is thereupon opened again, whereby auxiliary branch 15 and main branch 14 are separated and the circular current Ic peters out. A second, 'normal' switching-over of the load changeover switch 60 is thereby ended, which represents a load changeover. The on-load tap changer 11 is now in the position of FIG. 9*f*3.

The further selector arm 36 is separated from the commutation contact 200 in a step g and contacted with the eighth tap contact 208. The on-load tap changer 11 is now in the position of FIG. 9*g*.

The switch 62 is closed in a step h. The load changeover to the tap contact 201 and also the tap switching from setting 9 to setting 8 are thereby concluded. The on-load tap changer 11 is now in the end position of FIG. 9*h*.

Figure 9H:
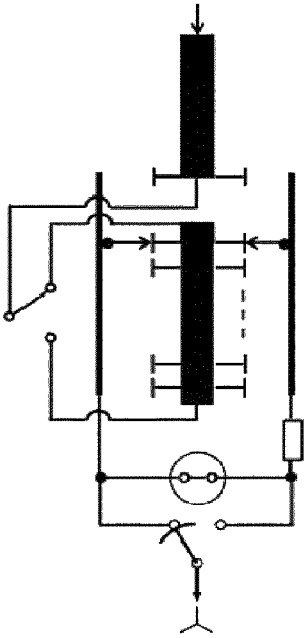

If, for example, the tap switching is now to be carried out in the opposite direction, thus from setting 8 to setting 9, then the switching sequence described in the figures FIG. 9 to FIG. 9*h* takes place in exactly the reverse sequence.

Figure 10:
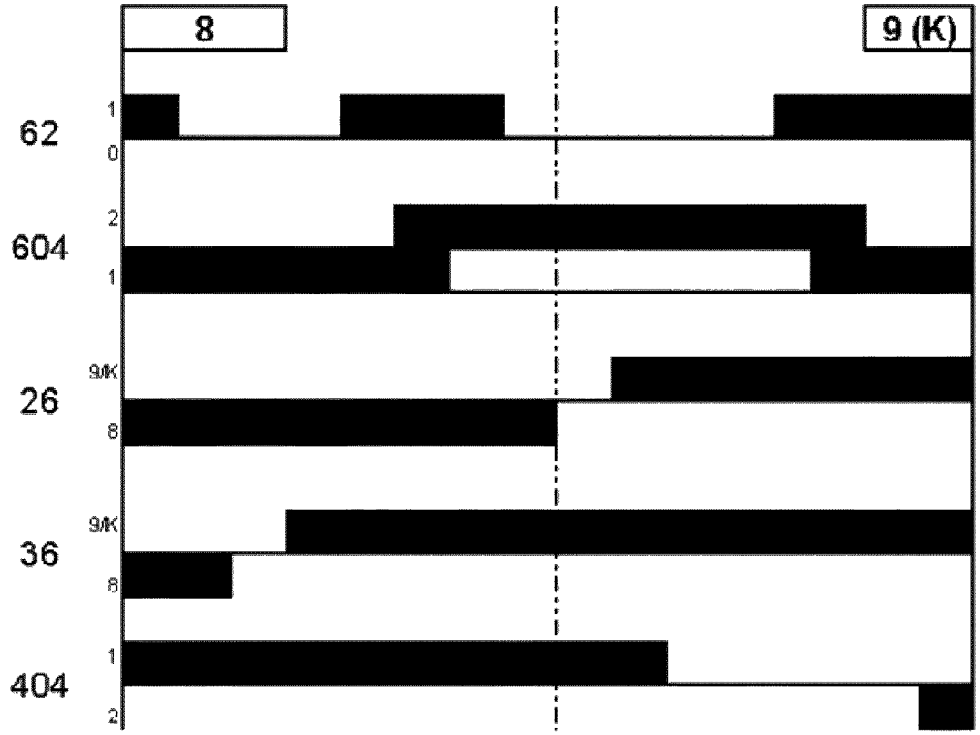
FIG. 10 shows a time dependency diagram of the switching sequence of FIG. 9 to FIG. 9*h;*

FIG. 10 shows a time dependency lapse diagram of the switching sequence of FIG. 9 to FIG. 9*h*. The lines arranged from top to bottom define the positions of the switch 62, the switching-over contact 604, the first selector arm 26, the second selector arm 36 and the preselector moved contact 404 in the time plot of a complete tap change from setting 8 to setting 9 or in reverse direction. The vertical dashed line marks the instant at which the switching-over of the preselector 40 must end at the latest or has to be started at the earliest, namely when one of the selector arms 26, 36 contacts the commutation contact 200 and the other selector arm no longer contacts or still does not contact the tap contact 208.

The time dependency diagram is to be read from right to left for the first form of embodiment, which is described in FIG. 9 to FIG. 9*h*, of the switching sequence. It can be seen on the basis of the time dependency diagram that initially in accordance with step a the preselector moved contact 404 is moved from the second setting to the intermediate setting, then according to part steps b1 and b2 the switching-over contact 604 is moved from the first setting to the bridging setting and from there to the second setting, thereupon according to part step b3 the switch 62 is opened, and then according to step c the preselector moved contact 404 is moved from the intermediate setting to the first setting. In the case of consideration of the time dependency diagram from left to right, this run takes place in exactly reverse sequence.

Figure 11:
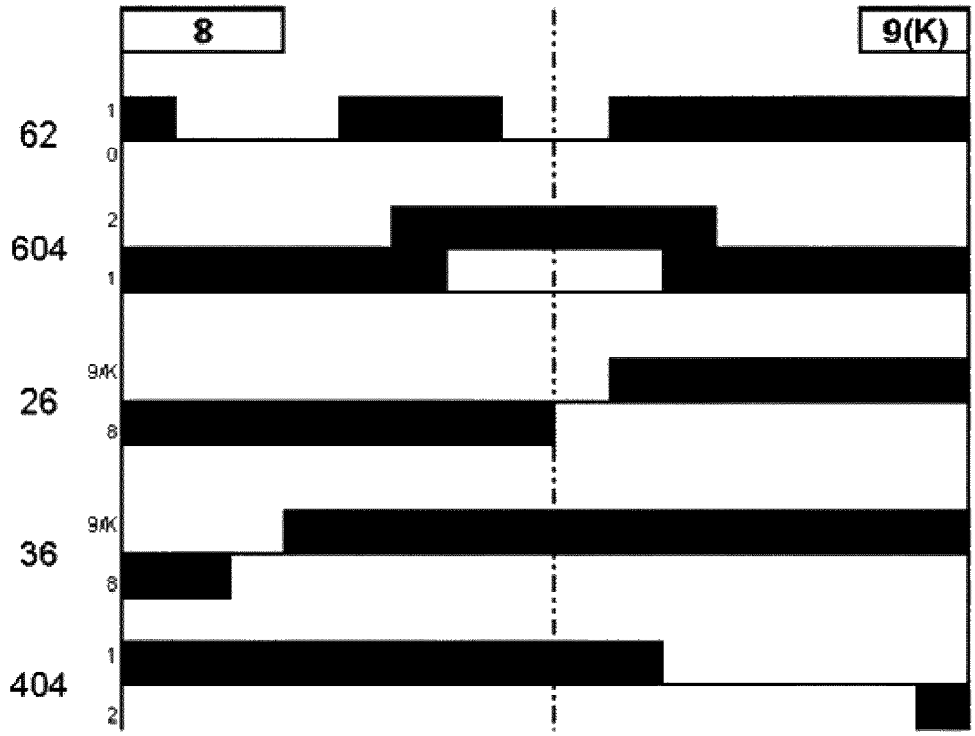
FIG. 11 shows a time dependency diagram of a second form of embodiment of the switching sequence.

A time dependency diagram of a second form of embodiment of the switching sequence is illustrated in FIG. 11. This form of embodiment is similar to the first form of embodiment in FIG. 10, so that in the following primarily the differences are explained in more detail. In this form of embodiment, as in the case of the first form of embodiment, initially according to step a the preselector moved contact 404 is moved to the intermediate setting and then according to part step b1 the switching-over contact 604 is moved from the first setting to the bridging setting. However, then—in departure from the first form of embodiment—according to step c the preselector moved contact 404 is moved from the intermediate setting to the first setting, at the same time according to part step b2 the switching-over contact 604 is moved from the bridging setting to the second setting and thereupon according to part step 3*b* the switch 62 is opened. Thus, in this form of embodiment the switching-over of the preselector 40 is ended before the switching-over of the load changeover switch 60. In opposite direction, as a difference from the first form of embodiment of the switching sequence, the switch 62 is actuated ahead of the preselector moved contact 404.

Figure 12:
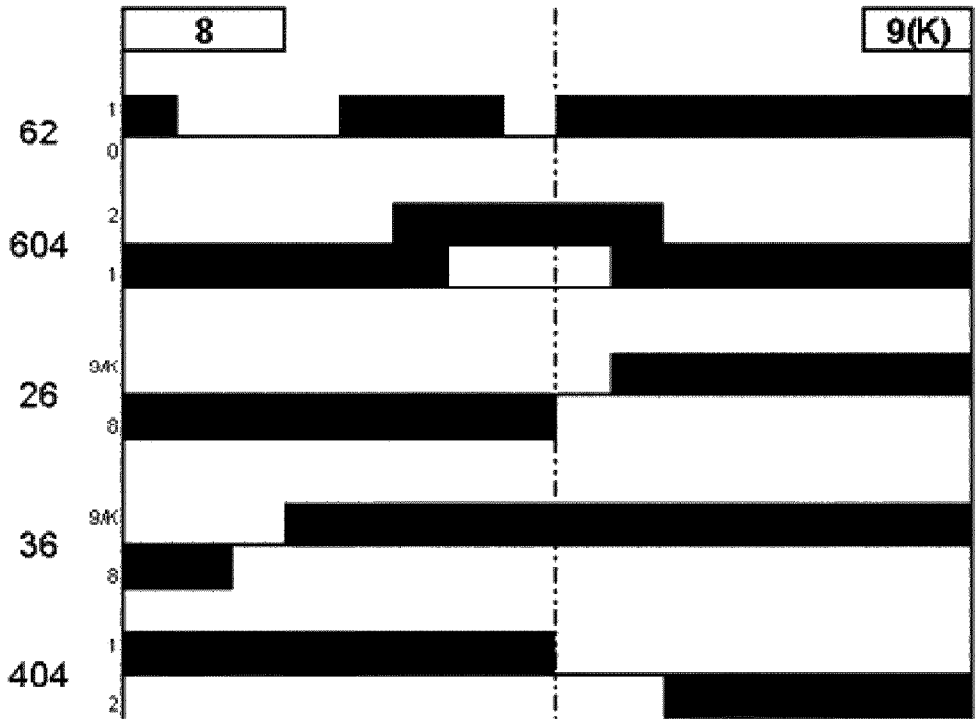
FIG. 12 shows a time dependency diagram of a third form of embodiment of the switching sequence.

A time dependency diagram of a third form of embodiment of the switching sequence is illustrated in FIG. 12. This form of embodiment is similar to the first form of embodiment in FIG. 11, so that in the following primarily the differences are explained in more detail. In this form of embodiment the switching-over processes of the load changeover switch 60 and the preselector 40 are begun simultaneously and also ended simultaneously in the case of consideration of the switching sequence in both directions.

Figure 13:
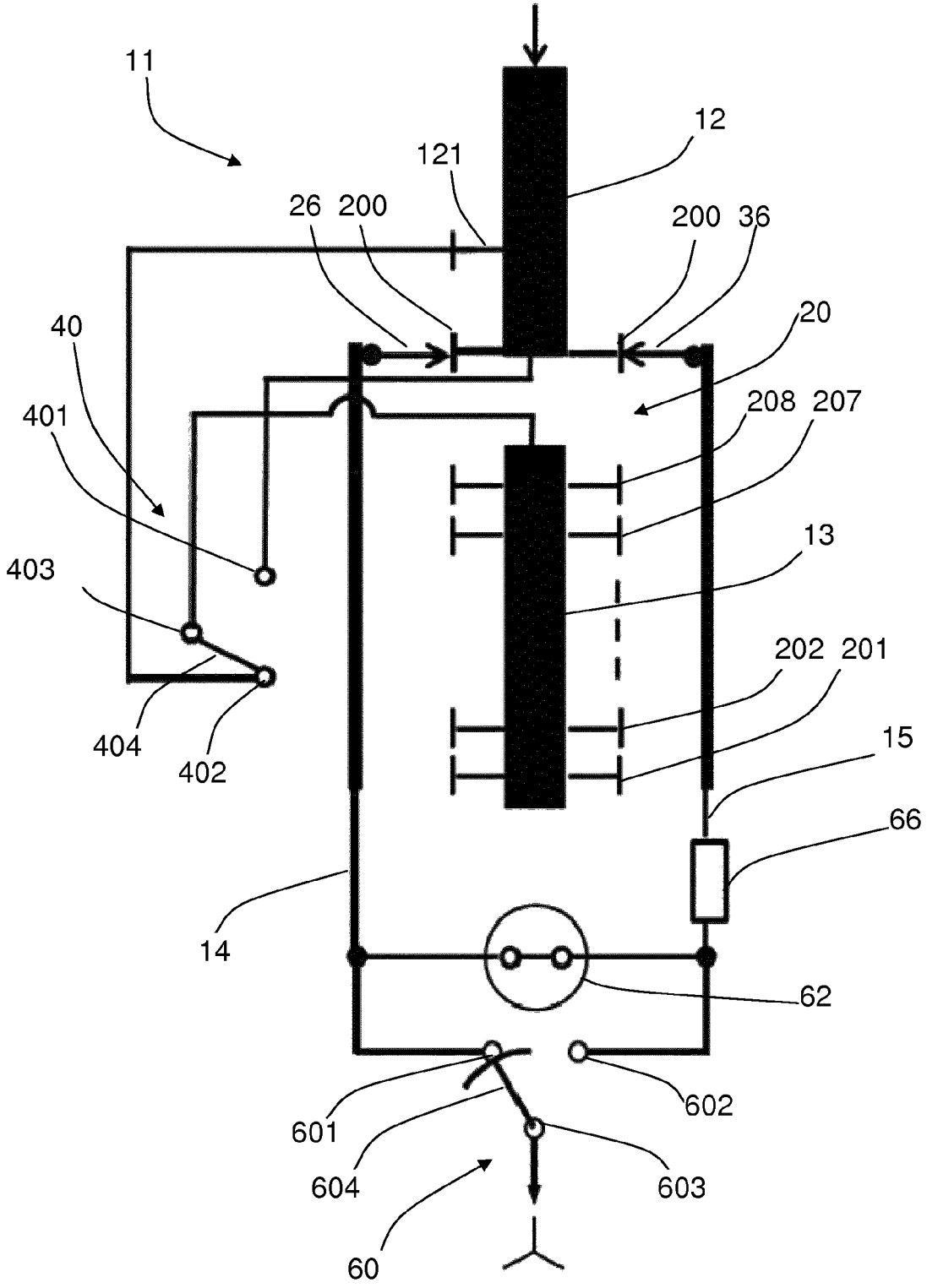
FIG. 13 shows a switching plan for a second form of embodiment of a regulating transformer.

A switching plan for a phase of a second form of embodiment of the regulating transformer 10 is illustrated in FIG. 13. This form of embodiment is similar to the first form of embodiment of FIG. 9, so that in the following primarily the differences are explained in more detail. In this form of embodiment the main winding 12 includes a tap 121, which forms the upper end of a coarse tap of the main winding 12. The lower end of the main winding 12 forms the lower end of the coarse tap.

In this form of embodiment the preselector 40 is used as a coarse selector and serves the purpose of selectably connecting or not connecting the coarse tap with the regulating winding 13. The first preselector fixed contact 401 is connected with the lower end of the main winding 12 and constantly with the commutation contact 200. The second preselector fixed contact 402 is connected with the tap 121 of the main winding 12. The third preselector fixed contact 403 is connected with an end of the regulating winding 13.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

The following is a list of reference numerals used herein:

10 regulating transformer
11 on-load tap changer
12 main winding of 10
121 tap of 12
13 regulating winding of 10
14 main branch of 11
15 auxiliary branch of 11
16 rod
17 drive shaft of 11
18 bevel gear transmission
19 motor
20 fine selector of 11
200 commutation contact of 20
201 . . . 208 tap contacts of 20
200 . . . 208 selector fixed contacts of 20
21 fine selector base plate
211/212 first/second side of 21
22 lines
23 axis
24 first selector Geneva wheel
25 first bearing axle
26 first selector arm
27 first selector driver
28 first selector entrainer
29 terminal
34 second selector Geneva wheel
35 second bearing axle
36 second selector arm
37 second selector driver
38 second selector entrainer
39 terminal
40 preselector of 11
401/402/403 first/second/third preselector fixed contact of 40
404 preselector moved contact of 40
41 preselector base plate
411/412 first/second side of 41
42 preselector driver
421 first preselector entrainer
43 first axis
44 preselector Geneva wheel
441 second preselector entrainer
45 first bearing axle
46 rocker
461 mouth of 46
47 second axis
48 second bearing axle
49 lines
50 contact housing
60 load changeover switch of 11
601/602 first/second terminal of 60
603 diverter line of 60
604 movable switching-over contact of 60
61 load changeover switch base plate
611/612 first/second side of 61
62 switch
621/622 fixed contact/moved contact of 62
63 holder
64 cam disc
641 contour of 64
65 rocker lever
651 one end of 65
66 resistance
67 first gearwheel
68 switching element
69 second gearwheel
70 connecting rod

The invention claimed is:

1. A method for switching an on-load tap changer, wherein the on-load tap changer comprises:

a fine selector, which comprises:

a plurality of selector fixed contacts comprising a commutation contact, which is connectable with a main winding of a regulating transformer, and a plurality of tap contacts, which are respectively connectable with an associated tap of a regulating winding of the regulating transformer;

a first selector arm, which is configured to selectably contact each of the selector fixed contacts; and a second selector arm, which is configured to selectably contact each of the selector fixed contacts;

a preselector, which is switchable over from a first setting to a second setting, and conversely, which is connectable with the regulating winding and the main winding, and which comprises:

a first preselector fixed contact, a second preselector fixed contact, and a third preselector fixed contact, which is connected in the first setting with the first preselector fixed contact, and in the second setting, connected with the second preselector fixed contact; and a load changeover switch, which is switchable over from a first changeover setting to a second changeover setting, and conversely, and which comprises:

a first terminal connected with the first selector arm, a second terminal connected with the second selector arm, and a diverter line connected in the first changeover setting with the first terminal and in the second changeover setting with the second terminal;

wherein the method comprises, when the preselector is to be switched over, then:

the first selector arm and the second selector arm are set in such a way that one of the first selector arm or the second selector arm contacts the commutation contact and the other one of the first selector arm or the second selector arm does not contact any of the tap contacts, and switching over of the load changeover switch begins before switching over of the preselector has ended.

2. The method according to claim 1, wherein the switching-over of the load changeover switch takes place during switching-over of the preselector.

3. The method according to claim 1, wherein:

the switching-over of the load changeover switch takes place exactly once;

during the switching-over of the load changeover switch there is no flow of circular current.

4. The method according to claim 1, wherein the preselector comprises:

a preselector-moved contact, which is able to be in a first contact setting in which it contacts the first preselector fixed contact, a second contact setting in which it contacts the second preselector fixed contact, and an intermediate setting in which it does not contact either of the first preselector fixed contact or the second preselector fixed contact;

wherein, for switching-over of the preselector from the second setting to the first setting, the method comprises:

in a step (a), the preselector-moved contact is moved from the second contact setting to the intermediate contact setting;

in a step (b), the load changeover switch is switched over;

in a step (c), the preselector-moved contact is moved from the intermediate contact setting to the first contact setting;

wherein the method comprisesconverse operations for switching-over of the preselector from the first setting to the second setting;

wherein the load changeover switch comprises:

a movable switching-over contact, which is able to be in a first switching-over setting in which it contacts the first terminal, a second switching-over setting in which it contacts the second terminal, and a bridging setting in which it contacts both of the first terminal and the second terminal; and wherein the method comprises, in step (b):

in the case of switching-over of the preselector from the second setting to the first setting, the switching-over contact is switched from the first switching-over setting to the bridging setting, and thereafter from the bridging setting to the second switching-over setting; and in the case of reverse switching-over of the preselector, the switching-over contact is switched from the second switching-over setting to the bridging setting, and thereafter from the bridging setting to the first switching-over setting.

5. The method according to claim 4, wherein the load changeover switch comprises:

a switch connected between the first terminal and the second terminal; and a resistance connected between the second terminal and the second selector arm; and wherein that method further comprises that the switch is closed during step (b).

6. An on-load tap changer for a regulating transformer, the on-load tap changer comprising:

a fine selector, which comprises:

a plurality of selector fixed contacts comprising a commutation contact, which is connectable with a main winding of the regulating transformer, and a plurality of tap contacts, which are respectively connectable with an associated tap of a regulating winding of the regulating transformer;

a first selector arm, which is configured to selectably contact each of the selector fixed contacts; and a second selector arm which is configured to selectably contact each of the selector fixed contacts;

a preselector, which is switchable over from a first setting to a second setting, and conversely, which is connectable with the regulating winding and the main winding, and which comprises:

a first preselector fixed contact, a second preselector fixed contact, and a third preselector fixed contact, which is connected in the first setting with the first preselector fixed contact, and which is connected in the second setting with the second preselector fixed contact;

a load changeover switch, which is switchable over from a first changeover setting to a second changeover setting, and conversely, and which comprises:

a first terminal connected with the first selector arm, a second terminal connected with the second selector arm, and a diverter line connected in the first changeover setting with the first terminal and in the second setting with the second terminal; and a common drive shaft for the preselector, the fine selector, and the load changeover switch, wherein the preselector, the fine selector, and the load changeover switch are each separately coupled to the drive shaft, wherein the preselector comprises a preselector base plate with a first side and a second, opposite side, and wherein the drive shaft extends through the preselector base plate and is rotatably mounted thereon.

7. An on-load tap changer according to claim 6, wherein the preselector comprises a preselector-moved contact, which is able to be in a first contact setting in which it contacts the first preselector fixed contact, a second contact setting in which it contacts the second preselector fixed contact, and an intermediate setting in which it contacts neither of the first preselector fixed contact nor the second preselector fixed contact.

8. The on-load tap changer according to claim 6, comprising:

a movable switching-over contact, which is able to be in a first switching-over setting in which it contacts the first terminal, a second switching-over setting in which it contacts the second terminal, and a bridging setting in which it contacts both the first terminal and the second terminal;

a switch connected between the first terminal and the second terminal; and a resistance connected between the second terminal and the second selector arm.

9. The on-load tap changer according to claim 6, wherein:

the preselector comprises:

a preselector driver on the first side, the preselector driver being seated on the drive shaft to be secure against relative rotation and carrying a first preselector entrainer;

a preselector Geneva wheel on the first side, the Geneva wheel being rotatably mounted on the preselector base plate and carrying a second preselector entrainer;

a rocker on the first side, the rocker being pivotably mounted on the preselector base plate and having a mouth for the second entrainer;

the preselector fixed contacts and the preselector moved contact are arranged on the second side of the preselector base plate;

the rocker is connected with the preselector moved contact to be secure against relative rotation;

the first entrainer is configured to co-operate with the preselector Geneva wheel such that, in the case of a complete revolution of the preselector driver, the preselector Geneva wheel rotates through only a fraction of a complete revolution, wherein this fraction corresponds with a switching process of the fine selector from one selector fixed contact to an adjacent selector fixed contact; and the second entrainer is configured to co-operates with the rocker such that, when one of the selector arms contacts one of the tap contacts, the second entrainer, in the case of rotation of the preselector Geneva wheel through the fraction, does not engage in the mouth, and when one of the selector arms contacts the commutation contact and the other selector arm does not contact any of the tap contacts, the second entrainer is configured to engage in the mouth that the preselector moved contact is switched over.

10. The on-load tap changer according to claim 6, wherein:

the preselector is a reversing switch;

the first preselector fixed contact is connectable with a first end of the regulating winding;

the second preselector fixed contact is connectable with a second end of the regulating winding;

the third preselector fixed contact is connectable with the main winding;

the third preselector fixed contact is constantly connected with the commutation contact.

11. The on-load tap changer according to claim 6, wherein:

the preselector is a coarse selector;

the first preselector fixed contact is connectable with an end of the main winding;

the second preselector fixed contact is connectable with a tap of the main winding;

the third preselector fixed contact is connectable with an end of the regulating winding; and the first preselector fixed contact is constantly connected with the commutation contact.

12. The on-load tap changer according to claim 6, comprising:

a first coupler coupling the preselector to the drive shaft; and a second coupler coupling the fine selector to the drive shaft, and wherein the first coupler and the second coupler are constructed separately from one another and/or have no common components.

13. A regulating transformer comprising:

a main winding;

a regulating winding with a plurality of taps; and an on-load tap changer according to claim 6;

wherein the commutation contact is connected with the main winding and the tap contacts are each connected with an associated tap of the regulating winding; and the preselector is connected with the regulating winding and the main winding.

* * * * *